US010831147B2

(12) United States Patent
Tomatsu

(10) Patent No.: US 10,831,147 B2
(45) Date of Patent: Nov. 10, 2020

(54) IMAGE-FORMING APPARATUS INCLUDING DRUM UNIT AND SUPPORT MEMBER FOR SUPPORTING DEVELOPING CARTRIDGES AND EXPOSURE HEADS

(71) Applicant: Brother Kogyo Kabushiki Kaisha, Nagoya-shi, Aichi-ken (JP)

(72) Inventor: Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/279,495

(22) Filed: Feb. 19, 2019

(65) Prior Publication Data

US 2019/0278216 A1 Sep. 12, 2019

(30) Foreign Application Priority Data

Mar. 6, 2018 (JP) ..... 2018-040049
Mar. 6, 2018 (JP) ..... 2018-040050
Mar. 6, 2018 (JP) ..... 2018-040052
Mar. 6, 2018 (JP) ..... 2018-040054

(51) Int. Cl.
*G03G 21/16* (2006.01)

(52) U.S. Cl.
CPC ..... *G03G 21/1647* (2013.01); *G03G 21/1666* (2013.01); *G03G 21/1671* (2013.01); *G03G 21/1676* (2013.01)

(58) Field of Classification Search
CPC ..... G03G 21/1647; G03G 21/1666; G03G 21/1671; G03G 21/1676
See application file for complete search history.

(56) References Cited

U.S. PATENT DOCUMENTS

| | | | | |
|---|---|---|---|---|
| 9,146,528 | B2 | 9/2015 | Okabe | |
| 9,429,901 | B2 | 8/2016 | Okabe | |
| 10,180,653 | B2 | 1/2019 | Yokoi | |
| 2012/0163857 | A1* | 6/2012 | Kamimura | G03G 21/1633 399/110 |
| 2013/0164033 | A1* | 6/2013 | Okabe | G03G 21/1633 399/119 |
| 2015/0277345 | A1 | 10/2015 | Yokoi | |
| 2015/0370219 | A1* | 12/2015 | Ogino | G03G 21/1676 399/110 |
| 2016/0018782 | A1 | 1/2016 | Okabe | |
| 2017/0108826 | A1 | 4/2017 | Yokoi | |

FOREIGN PATENT DOCUMENTS

| | | | |
|---|---|---|---|
| JP | 2006-064835 | A | 3/2006 |
| JP | 2013-134371 | A | 7/2013 |
| JP | 2015-194563 | A | 11/2015 |

* cited by examiner

*Primary Examiner* — Joseph S Wong
(74) *Attorney, Agent, or Firm* — Banner & Witcoff, Ltd.

(57) ABSTRACT

An image-forming apparatus includes: a drum unit including a photosensitive drum; an exposure head configured to expose the photosensitive drum to light; a developing cartridge configured to store developer therein; and a support member configured to support the exposure head and the developing cartridge. The support member is pivotally movable between an exposure position and a separation position. The exposure head is able to expose the photosensitive drum to light at the exposure position. The exposure head is positioned away from the photosensitive drum when the support member is at the separation position.

8 Claims, 24 Drawing Sheets

UP
DOWN
FRONT
REAR
95A
434
95
94
50
42
41
62
60
92(93)
61
432(433)
391
C31
C
396
H32
D31
C32
310B
F31
F32
F
H31
43
431

C34
C35
D32
D33

IMAGE-FORMING APPARATUS INCLUDING DRUM UNIT AND SUPPORT MEMBER FOR SUPPORTING DEVELOPING CARTRIDGES AND EXPOSURE HEADS

CROSS REFERENCE TO RELATED APPLICATION

This application claims priorities from Japanese Patent Application Nos. 2018-040049 filed Mar. 6, 2018, 2018-040050 filed Mar. 6, 2018, 2018-040052 filed Mar. 6, 2018, and 2018-040054 filed Mar. 6, 2018. The entire contents of the above-mentioned priority applications are incorporated herein by reference.

TECHNICAL FIELD

The present disclosure relates to an image-forming apparatus including photosensitive drums, exposure heads, and developing cartridges.

BACKGROUND

Conventionally, there are known image-forming apparatuses each including: a support member including a plurality of exposure heads and a plurality of developing cartridges; and a drum unit including a plurality of photosensitive drums (see Japanese Patent Application Publication No. 2013-134371). The drum unit of this reference includes a plurality of drum cartridges each including one of the photosensitive drums.

In this image-forming apparatus, the support member is configured to pivot upward and downward. As the support member is pivoted toward the drum unit, bosses of each developing cartridge supported by the support member are guided by corresponding linear-shaped guides formed in the drum unit. The developing cartridges are thus fixed in position relative to the photosensitive drums.

In the above-identified image-forming apparatus, the respective drum cartridges can be replaced after the support member positioned above the drum cartridges is pivoted upward.

Further, in the above-identified image-forming apparatus, the exposure heads are supported by the support member via springs so as to protrude downward relative to the support member. As the support member is pivoted toward the drum unit, bosses of each exposure head are engaged with corresponding positioning grooves formed in the drum unit to provide positioning of the exposure heads relative to the photosensitive drums.

SUMMARY

Conceivably, curved guides may be formed in the drum unit due to some structural constrains. In this case, if the developing cartridges attached to the support member are restricted from moving relative to the support member, bosses of the developing cartridges may be stuck in the corresponding curved guides. The developing cartridges may not be suitably positioned relative to the photosensitive drums.

Further, in order to facilitate replacement of the plurality of photosensitive drums, the plurality of photosensitive drums may be held by a single drum frame of the drum unit. However, in a case where such a drum unit is to be positioned relative to a main casing of the apparatus, the plurality of photosensitive drums may be rubbed against a belt of the main casing. Such rubbing of the photosensitive drums against the belt may increase friction resistance therebetween, possibly leading to failure in accurate poisoning of the drum unit relative to the main casing.

Still further, in the above image-forming apparatus, the exposure heads are supported by the support member via springs so that the exposure heads are hung beneath the support member. Accordingly, the exposure heads may rattle while the support member is pivoted away from the drum unit.

In order to enhance operability of the support member and facilitate removal of the drum unit disposed below the support member, a handle may be provided at each of the support member and the drum unit. However, in this structure, a user trying to pivot the support member may accidentally grab the handle of the drum unit together with the handle of the support member. Resultant failure in pivoting of the support member may bring a feeling of discomfort to the user.

In view of the foregoing, it is an object of the present disclosure to provide an image-forming apparatus capable of realizing reliable positioning of developing cartridges relative to photosensitive drums of a drum unit formed with curved guides.

It is another object of the present disclosure to provide an image-forming apparatus capable of providing accurate positioning of a drum unit including a plurality of photosensitive drums relative a main casing.

It is still another object of the present disclosure to provide an image-forming apparatus capable of suppressing rattling of exposure heads in a state where a support member is separated from a drum unit.

It is still another object of the present disclosure to provide an image-forming apparatus capable of preventing a user from grabbing a handle of a drum unit together with a handle of a support member.

In order to attain the above and other objects, according to one aspect, the present disclosure provides an image-forming apparatus including a drum unit, an exposure head, a developing cartridge and a support member. The drum unit includes a photosensitive drum. The exposure head is configured to expose the photosensitive drum to light. The developing cartridge is configured to store developer therein. The support member is configured to support the exposure head and the developing cartridge. The support member is pivotally movable between an exposure position where the exposure head is able to expose the photosensitive drum to light and a separation position where the exposure head is positioned away from the photosensitive drum.

DETAILED DESCRIPTION

First Embodiment

A color printer 1 as an example of an image-forming apparatus according to a first embodiment of the present disclosure will be described in detail while referring to FIGS. 1 through 11.

In the following description, an overall structure of the color printer 1 will be briefly described first, and specific characteristic features of the present embodiment will be described thereafter in detail.

Figure 1:
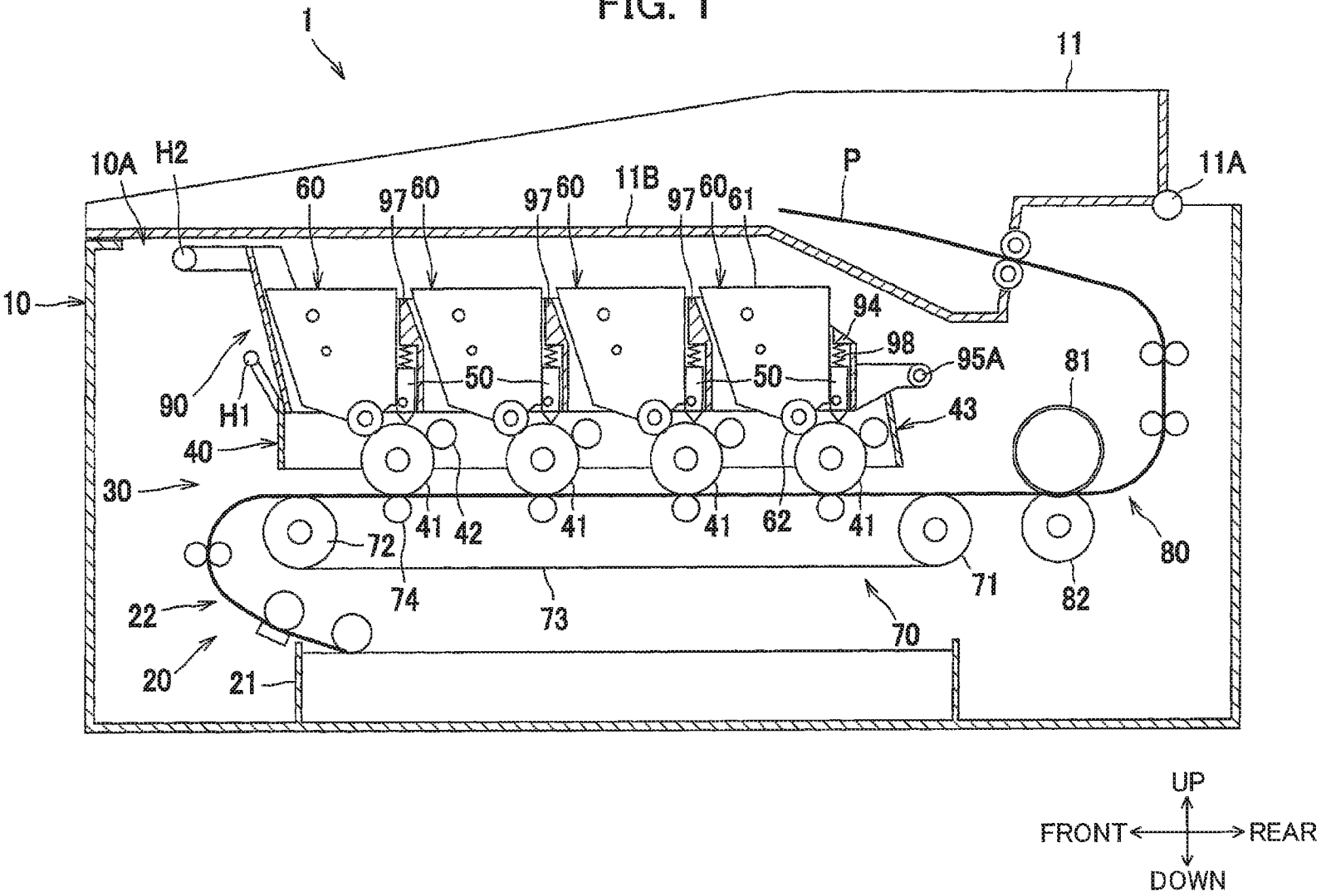
FIG. 1 is a schematic cross-sectional view illustrating an internal structure of a color printer according to a first embodiment of the disclosure.
Figure 2:
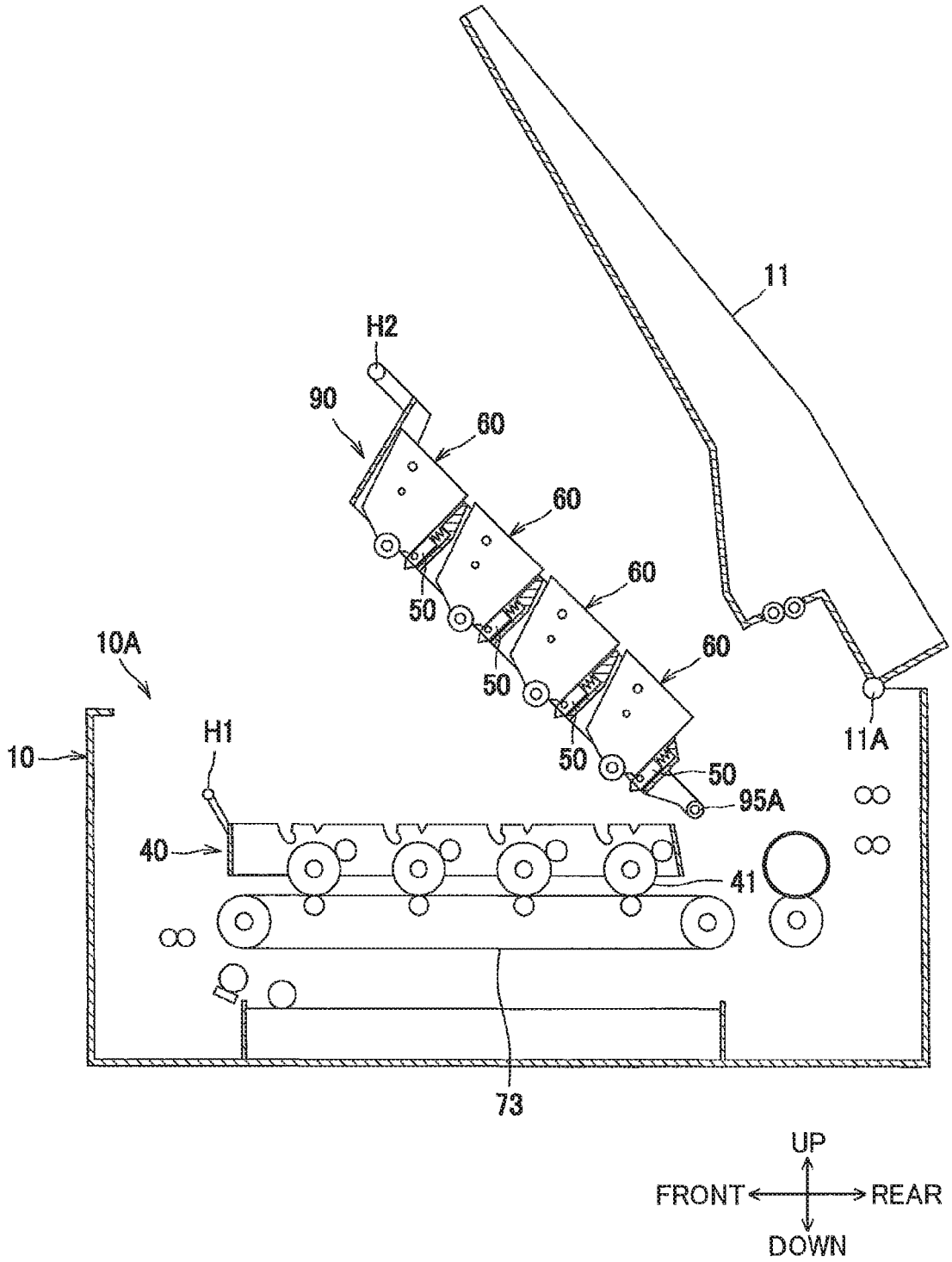
FIG. 2 is a schematic cross-sectional view of the color printer according to the first embodiment in a state where a top cover thereof is opened.

Throughout the specification, directions will be referenced based on an orientation of the color printer 1 illustrated in FIG. 1. That is, a left side and a right side in FIG. 1 will be referred to as "front" and "rear", respectively. A far side and a near side in FIG. 1 will be referred to as "left" and "right", respectively. An upper side and a lower side in FIG. 1 will be referred to as "top" and "bottom", respectively.

As illustrated in FIG. 1, the color printer 1 includes a main casing 10, a top cover 11, a sheet-feeding portion 20, and an image-forming portion 30. The sheet-feeding portion 20 and the image-forming portion 30 are provided in the main casing 10.

The main casing 10 has an opening 10A that is open upward. The top cover 11 is a cover configured to open and close the opening 10A. The top cover 11 is disposed at an upper end portion of the main casing 10. The top cover 11 has a rear end portion provided with a pivot shaft 11A. The top cover 11 is pivotable relative to the main casing 10 about an axis of the pivot shaft 11A (refer to FIG. 2).

The sheet-feeding portion 20 is provided in a lower portion of the main casing 10. The sheet-feeding portion 20 includes a sheet tray 21 and a sheet-feeding mechanism 22. The sheet tray 21 is configured to accommodate sheets P therein. The sheet-feeding mechanism 22 is configured to feed the sheets P from the sheet tray 21 to the image-forming portion 30. The sheets P in the sheet tray 21 are separated one by one by the sheet feeding mechanism 22, and then fed to the image-forming portion 30.

The image-forming portion 30 includes a drum unit 40, four exposure heads 50, four developing cartridges 60, a transfer unit 70, and a fixing unit 80. The four exposure heads 50 and the four developing cartridges 60 are supported by a support member 90. The support member 90 is pivotable relative to the main casing 10 (see FIG. 2).

The drum unit 40 includes four photosensitive drums 41, four charging rollers 42, and a drum frame 43. The drum frame 43 rotatably supports the photosensitive drums 41 and the charging rollers 42. The four photosensitive drums 41 are arranged to be aligned with one another (juxtaposed) in a front-rear direction (prescribed direction). Each photosensitive drum 41 is rotatable about an axis thereof extending in a left-right direction. The charging rollers 42 are provided in one-to-one correspondence with the photosensitive drums 41. The charging rollers 42 are configured to electrically charge the respective photosensitive drums 41.

The exposure heads 50 are configured to expose peripheral surfaces of the respective photosensitive drums 41. The exposure heads 50 are provided in one-to-one correspondence with the photosensitive drums 41. Each exposure head 50 is disposed above the corresponding photosensitive drum 41. Each exposure head 50 has a lower end portion provided with light-emitting elements and imaging lenses.

The developing cartridges 60 are configured to supply developer to portions exposed by the exposure heads 50 on the peripheral surfaces of the respective photosensitive drums 41. The developing cartridges 60 are provided in one-to-one correspondence with the photosensitive drums 41. Each developing cartridge 60 mainly includes a developer accommodation portion 61 and a developing roller 62. The developer accommodation portion 61 is configured to accommodate developer therein. The developing roller 62 is configured to supply the developer in the developer accommodation portions 61 to the corresponding photosensitive drum 41. The developing cartridges 60 respectively store developer of yellow, magenta, cyan, and black in the respective developer accommodation portions 61 from front to rear. Note that, in the present embodiment, the developing cartridges 60 respectively have identical capacities.

The support member 90 is disposed above the drum unit 40. The support member 90 is pivotable between an exposure position (a position in FIG. 1) and a separation position (a position in FIG. 2). While the support member 90 is at the exposure position, the exposure heads 50 can expose the corresponding photosensitive drums 41 to light. The exposure heads 50 are positioned farther away from the photosensitive drums 41 when the support member 90 is at the separation position than when the support member 90 is at the exposure position. In a state where the support member 90 is at the separation position, the drum unit 40 is attachable to and detachable from the main casing 10 (see FIG. 3). The developing cartridges 60 are also attachable to and detachable from the support member 90.

The transfer unit 70 is provided between the sheet tray 21 and the drum unit 40. The transfer unit 70 includes a drive roller 71, a follow roller 72, a conveyor belt 73, and four transfer rollers 74. The conveyor belt 73 is an endless belt mounted over the drive roller 71 and the follow roller 72 under tension. The conveyor belt 73 has an outer peripheral surface in contact with each of the photosensitive drums 41. The transfer rollers 74 are disposed at an internal space defined by an inner peripheral surface of the conveyor belt 73 such that the conveyor belt 73 is nipped between each transfer roller 74 and the corresponding photosensitive drum 41.

The fixing unit 80 is disposed rearward of the transfer unit 70. The fixing unit 80 includes a heating roller 81 and a pressing roller 82. The pressing roller 82 is pressed toward the heating roller 81.

In the image-forming portion 30 described above, the peripheral surfaces of the photosensitive drums 41 are charged uniformly by the corresponding charging rollers 42 and then exposed to light by the corresponding exposure heads 50. Electrostatic latent images based on image data are thus formed on the peripheral surfaces of the respective photosensitive drums 41. As the developer is supplied from the developing rollers 62 to the respective photosensitive drums 41, the electrostatic latent images are developed into a visible image, thereby forming developer images on the respective photosensitive drums 41.

The developer images formed on the respective photosensitive drums 41 are sequentially superimposed and transferred by the transfer rollers 74 onto a sheet P on the conveyor belt 73. The sheet P with the developing agent images transferred thereon is then conveyed between the heating roller 81 and the pressing roller 82, whereby the developer images are thermally-fixed on the sheet P. The sheet P is then discharged out of the main casing 10 and placed on a discharge tray 11B formed on a lower wall of the top cover 11.

Next, the drum frame 43 of the drum unit 40 and the support member 90 will be described in detail. Specifically, structures for supporting the developing cartridges 60 and the exposure heads 50 will be described in detail.

Figure 4:
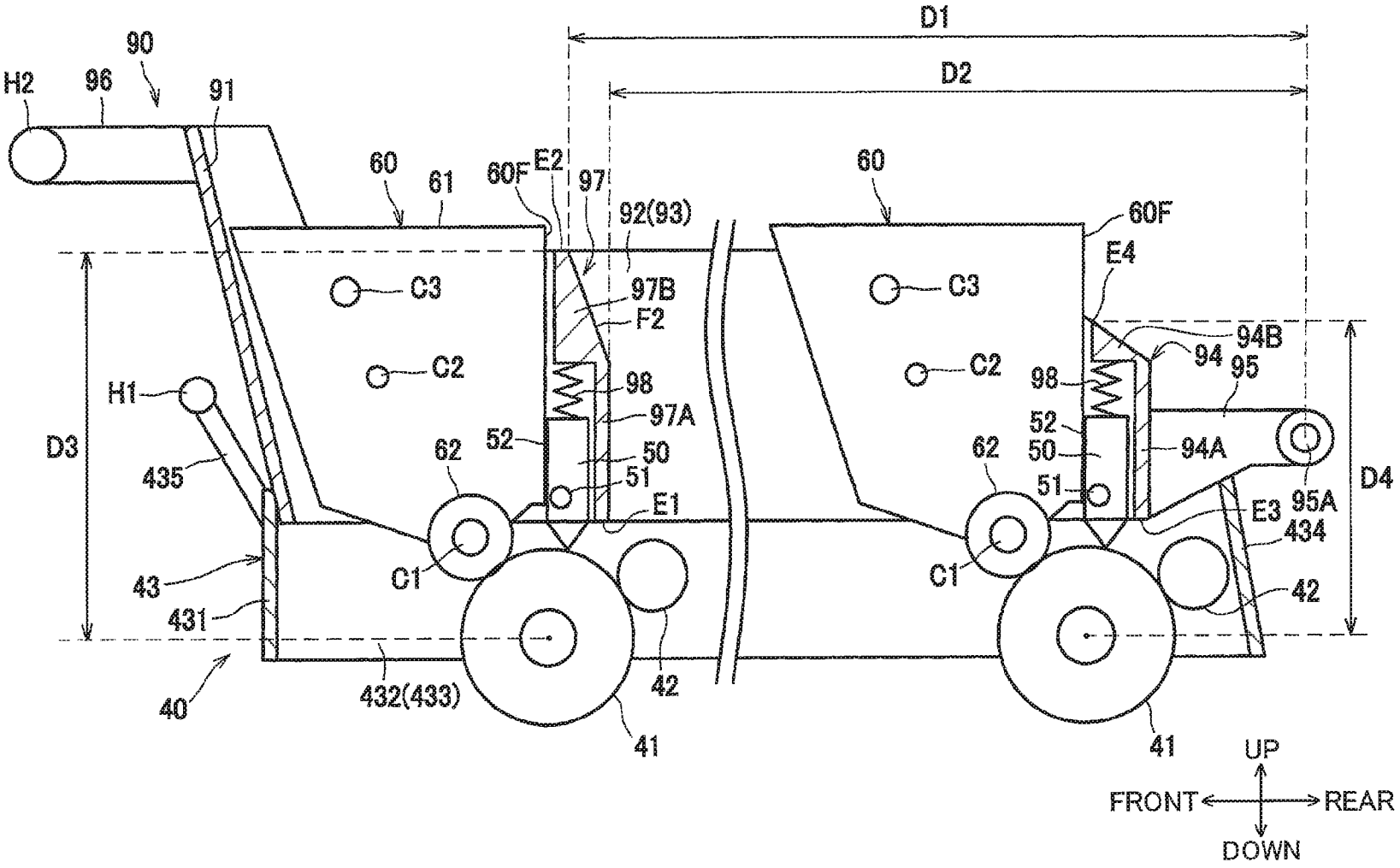
FIG. 4 is a partially-enlarged view schematically illustrating front and rear end portions of the drum unit and front and rear end portions of a support member according to the first embodiment.

As illustrated in FIGS. 1 and 4, the drum frame 43 includes a front wall 431, two side walls 432 and 433, a rear wall 434, and a handle H1. The front wall 431 is disposed frontward relative to the plurality of photosensitive drums 41.

The two side walls 432 and 433 are walls rotatably supporting the photosensitive drums 41. The two side walls 432 and 433 extend rearward from left and right end portions of the front wall 431, respectively. The rear wall 434 is disposed rearward relative to the photosensitive drums 41. The rear wall 434 connects rear end portions of the side walls 432 and 433.

The handle H1 is a columnar-shaped handle elongated in the left-right direction. Both end portions of the handle H1 in the left-right direction are connected to an upper end portion of the front wall 431 with two arm members 435. Specifically, the arm members 435 extend diagonally forward and upward from the upper end portion of the front wall 431. The handle H1 is fixed to respective tip end portions (front end portions) of the arm members 435.

The support member 90 includes a front wall 91, two side walls 92 and 93, a rear wall 94, and a handle H2. The front wall 91 is disposed frontward relative to the plurality of developing cartridges 60.

The two side walls 92 and 93 are walls supporting the developing cartridges 60 and the exposure heads 50. The two side walls 92 and 93 extend rearward from left and right end portions of the front wall 91, respectively. The two side walls 92 and 93 are arranged to interpose the developing cartridges 60 and the exposure heads 50 therebetween in the left-right direction, i.e., in an axial direction of each of the photosensitive drums 41. The rear wall 94 is disposed rearward relative to the plurality of developing cartridges 60. The rear wall 94 connects respective rear end portions of the side walls 92 and 93.

The rear wall 94 has left and right end portions each provided with an extending portion 95 extending rearward. A rear end portion of each extending portion 95 is supported by the main casing 10 to allow the support member 90 to pivot relative to the main casing 10. That is, the support member 90 is pivotable about one end portion thereof in a horizontal direction, specifically, the front-rear direction, relative to the main casing 10.

Specifically, each of the extending portions 95 includes a pivot shaft 95A about which the support member 90 is pivotable. The pivot shaft 95A is positioned at the rear end portion of each pivot shaft 95A. The support member 90 is thus configured to pivot about the pivot shaft 95A between the exposure position and the separation position. The pivot shaft 95A may be a circular column rotatably supported by holes formed in the main casing 10. Alternatively, the pivot shaft 95A may be holes in which columnar-shaped bosses of the main casing 10 are inserted to allow the support member 90 to pivot relative to the main casing 10. The pivot shaft 95A is disposed at the one end portion of the support member 90 in the front-rear direction.

The handle H2 is a columnar-shaped handle extending in the left-right direction. Both end portions of the handle H2 in the left-right direction are connected to an upper end portion of the front wall 91 via two handle supports 96. The handle supports 96 extend forward from both end portions in the left-right direction of the upper end portion of the front wall 91. The handle H2 is fixed to respective front end portions of the handle supports 96.

The support member 90 includes three first walls 97 each partitioning neighboring two of the developing cartridges 60 from each other. Each first wall 97 is joined to each of the two side walls 92 and 93. Specifically, the first walls 97 are joined to the respective side walls 92 and 93 by injecting resin into a single mold. Incidentally, the first walls 97 and a remaining portion of the support member 90 other than the first walls 97 may be manufactured separately by injection molding of resin into separate molds. In this case, the first walls 97 and the remaining portion of the support member 90 excluding the first walls 97 may be joined to each other with an adhesive agent or double-sided tapes, for example, to join the first walls 97 to the side walls 92 and 93.

Each first wall 97 includes a first portion 97A and a second portion 97B. The first portion 97A extends in an upper-lower direction. The second portion 97B is disposed on an upper end of the first portion 97A. The second portion 97B protrudes further forward relative to the first portion 97A. Each of the exposure heads 50 is disposed below the second portion 97B and frontward of the first portion 97A.

In other words, the second portion 97B overlaps with the corresponding exposure head 50 when viewed in the upper-lower direction, i.e., a direction orthogonal to the axial direction of the photosensitive drum 41 and to the prescribed direction (front-rear direction) in which the photosensitive drums 41 are juxtaposed. The first portion 97A overlaps with the corresponding exposure head 50 when viewed in the front-rear direction.

The second portion 97B has a rear surface that is inclined diagonally rearward and downward. The rear surface of the second portion 97B is connected to a rear surface of the first portion 97A. Specifically, the second portion 97B has an inclined surface F2 constituting the rear surface of the second portion 97B. The inclined surface F2 is inclined diagonally rearward and downward. Referring to FIG. 4, with respect to the prescribed direction, a distance D1 between an upper edge of the inclined surface F2 and a center of the pivot shaft 95A is greater than a distance D2 between a lower edge of the inclined surface F2 and the center of the pivot shaft 95A. Further, with respect to the prescribed direction, the second portion 97B has a greater width at its lower end portion than at its upper end portion. The first portion 97A is positioned at one end of the second portion 97B closer to the pivot shaft 95A (i.e., lower end of the second portion 97B). The first portion 97A has a width smaller than the width of the second portion 97B in the prescribed direction. Each exposure head 50 is positioned in a space whose four sides (left, right, upper, and rear) are defined by the first portion 97A, the second portion 97B, and the side walls 92 and 93. In other words, each of the exposure heads 50 is positioned in a recessed portion of the corresponding first wall 97. The support member 90 can thus have a smaller dimension in the prescribed direction, and the color printer 1 can be downsized in the prescribed direction.

The inclined surface F2 of the second portion 97B is connected to the rear surface of the first portion 97A. Accordingly, front surfaces of the developing cartridges 60, which are to be positioned rearward of the respective first walls 97, can be formed to be inclined diagonally along the inclined surface F2 of the second portion 97B. Providing such inclined front surface can realize enlargement of the capacity of each developing cartridge 60.

The rear wall 94 is disposed between a pivot center of the support member 90 (i.e., the pivot shaft 95A) and one of the developing cartridges 60 positioned closest to the pivot center (the pivot shaft 95A) among the four developing cartridges 60. The rear wall 94 has a shape similar to a shape of each first wall 97. Specifically, the rear wall 94 includes a first portion 94A extending in the upper-lower direction, and a second portion 94B disposed on an upper end of the first portion 94A.

The second portion 94B protrudes further forward than the first portion 94A does. Corresponding one of the exposure heads 50 is disposed below the second portion 94B and frontward of the first portion 94A. The second portion 94B has a rear surface that is inclined diagonally rearward and downward. The inclined rear surface of the second portion 94B is connected to a rear surface of the first portion 94A.

The rear wall 94 has an upper end that is positioned lower than an upper end of each first wall 97. Specifically, referring to FIG. 4, each of the first walls 97 has a first end E1 and a second end E2 opposite to the first end E1, the first end E1 being positioned closer to the corresponding photosensitive drum 41. The rear wall 94 has a third end E3 and a fourth end E4 opposite to the third end E3, the third end E3 being positioned closer to the corresponding photosensitive drum 41. The fourth end E4 of the rear wall 94 is positioned closer to the photosensitive drum 41 corresponding thereto than the second end E2 of each first wall 97 is to the photosensitive drum 41 corresponding thereto. In other words, a distance D4 between the fourth end E4 of the rear wall 94 and the axis of the photosensitive drum 41 corresponding thereto in the vertical direction is smaller than a distance D3 between the second end E2 of each first wall 97 and the axis of the photosensitive drum 41 corresponding thereto in the vertical direction.

The support member 90 also includes four head pressing members 98 each configured to press the corresponding exposure head 50 toward the photosensitive drums 41. The head pressing members 98 are compression coil springs, for example. Each head pressing member 98 is disposed between the corresponding exposure head 50 and the second portion (97B or 94B).

Each exposure head 50 includes a pair of protrusions 51. Each protrusion 51 protrudes outward in the left-right direction from one of side surfaces of the exposure head 50 in the left-right direction. That is, one of the protrusions 51 is provided at the left side surface of the exposure head 50, while the other protrusion 51 is provided at the right side surface of the exposure head 50. The protrusions 51 are columnar shaped.

Each exposure head 50 includes an opposing surface 52 that can face the corresponding developing cartridge 60 in the prescribed direction (i.e., the front-rear direction). The opposing surface 52 is orthogonal to the front-rear direction. Each developing cartridge 60 includes an opposing surface 60F that can face the opposing surface 52 of the corresponding exposure head 50. The opposing surfaces 52 of the exposure heads 50 are parallel to the opposing surfaces 60F of the respective developing cartridges 60.

Figure 5A:
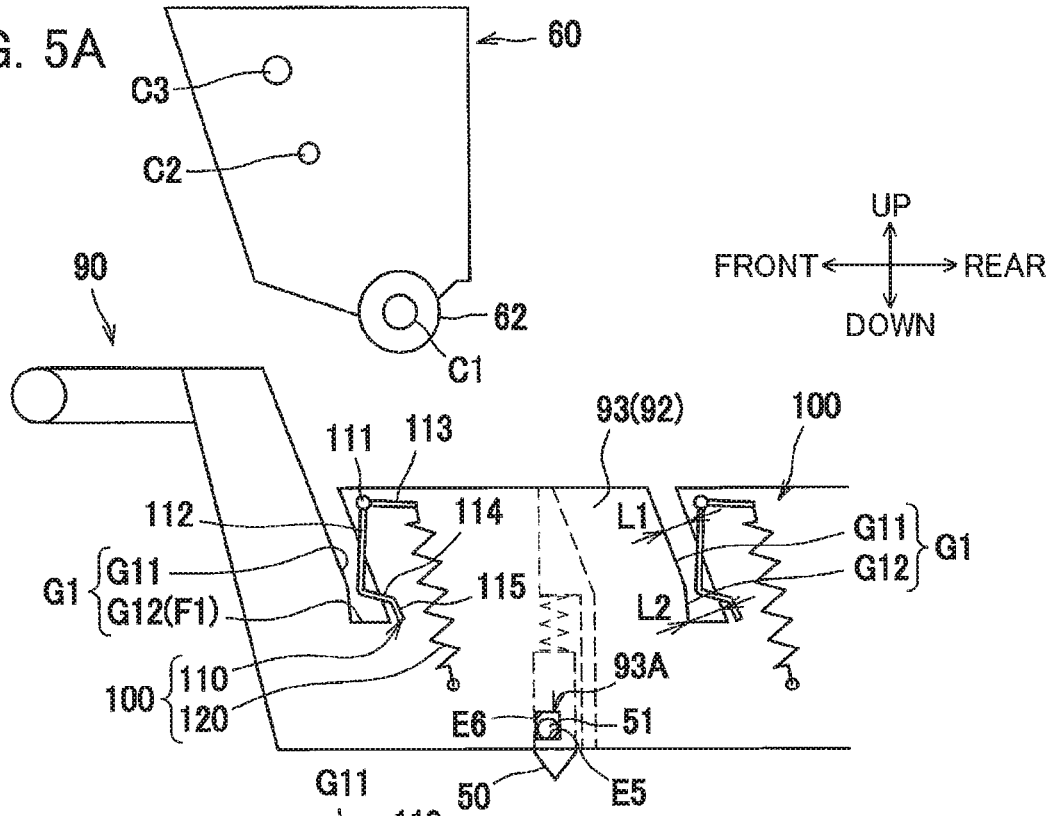
FIG. 5A is a side view of the support member according to the first embodiment in a state where a developing cartridge is detached from the support member.

As illustrated in FIG. 5A, the side wall 93 of the support member 90 is formed with grooves 93A each for movably supporting one of the protrusions 51 of the corresponding exposure head 50. Here, since the left side wall 92 has a similar structure to the structure of the right side wall 93, a description will be given for the right side wall 93 only and the left side wall 92 will not be described for simplifying description.

Figure 5B:
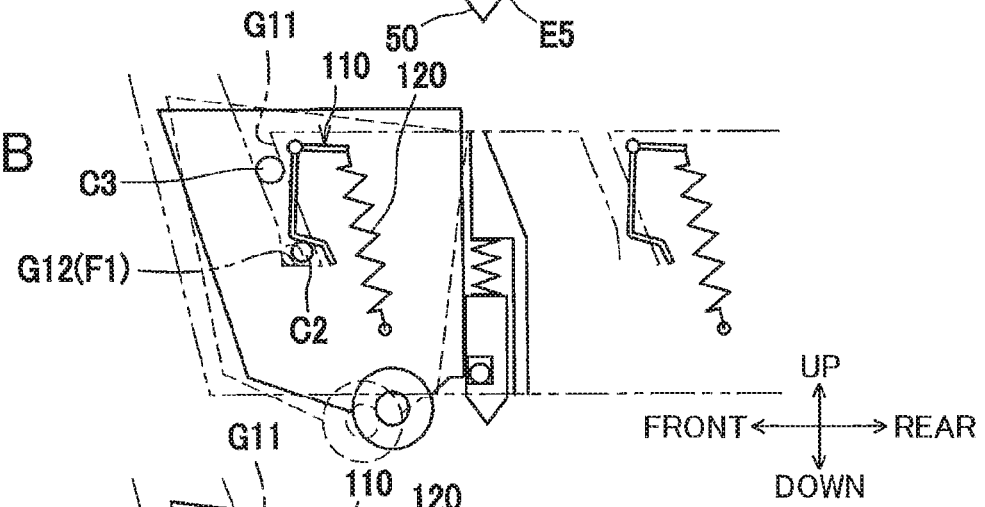
FIG. 5B is a view schematically illustrating a state where the developing cartridge attached to the support member according to the first embodiment is pivotable relative to the support member.
Figure 5C:
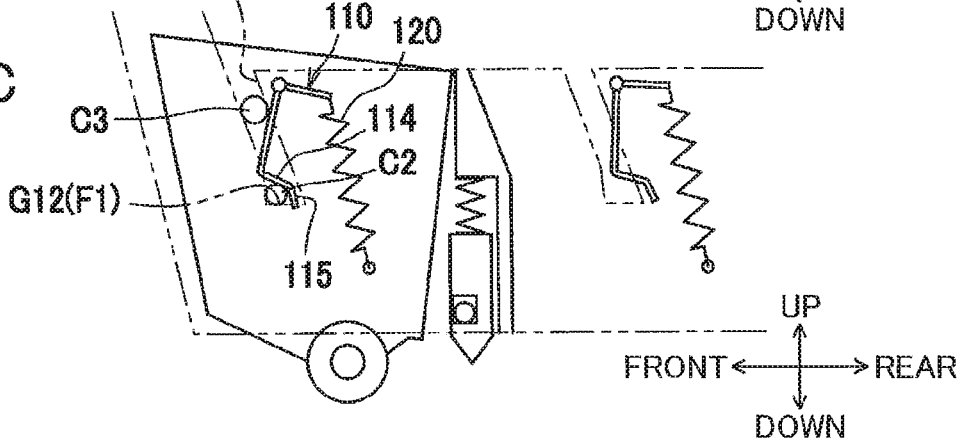
FIG. 5C is a view schematically illustrating a state where a second protrusion of the developing cartridge is nipped between a lever and a sub-guide of the support member according to the first embodiment.

Each of the grooves 93A includes one end E5 and another end E6 opposite to the one end E5, the one end E5 being positioned closer to the corresponding photosensitive drum 41 than the end E6. When the support member 90 is at the separation position, the protrusion 51 of each exposure head 50 is in contact with the one end E5 of the corresponding groove 93A. FIGS. 5A, 5B and 5C illustrate the support member 90 alone. Hence, a position of each protrusion 51 in FIGS. 5A, 5B and 5C corresponds to a position thereof when the support member 90 is at the separation position.

Referring to FIGS. 4 and 5A, each developing cartridge 60 includes a pair of first protrusions C1, a pair of second protrusions C2, and a pair of third protrusions C3. The first protrusions C1, second protrusions C2 and third protrusions C3 each protrude outward in the left-right direction, i.e., the axial direction of the photosensitive drum 41 from one of side surfaces of the developing cartridge 60 in the left-right direction. That is, the first protrusions C1, the second protrusions C2 and the third protrusions C3 are provided one each on the left surface and one each on the right surface of the developing cartridge 60.

The first protrusions C1, the second protrusions C2 and the third protrusions C3 are each columnar shaped. In particular, each of the first protrusions C1 is formed as a columnar shape centered on a rotational axis of the developing roller 62. The first protrusions C1 may be both end portions of a rotational shaft of the developing roller 62, or bearings configured to support the rotational shaft.

The second protrusions C2 are disposed farther away from the corresponding photosensitive drum 41 than the first protrusions C1 are from the photosensitive drum 41. The third protrusions C3 are disposed farther away from the corresponding photosensitive drum 41 than the second protrusions C2 are from the photosensitive drum 41.

The side wall 93 of the support member 90 includes cartridge guides G1 each configured to guide the second protrusion C2 and the third protrusion C3 of the corresponding developing cartridge 60 during attachment of the developing cartridge 60 to the support member 90. Each cartridge guide G1 includes a main guide G11 and a sub-guide G12. The main guide G11 is configured to guide the corresponding second protrusion C2 and third protrusion C3. The sub-guide G12 is connected to a lower end portion of the main guide G11.

The main guides G11 are grooves formed in the side wall 93. The main guides G11 extend in a substantially upper-lower direction, i.e., in a direction slightly inclined relative to the upper-lower direction (diagonally downward and rearward). In other words, the main guides G11 respectively extend in a third direction different from a second direction representing an extending direction of second guides G22 described later (see FIG. 6). The main guides G11 are open upward. The main guides G11 extend diagonally rearward and downward from an upper end of the side wall 93, and are connected to the respective sub-guides G12.

The sub-guides G12 are grooves formed in the side wall 93. Each sub-guide G12 includes a bottom surface F1 positioned closest to the corresponding photosensitive drum 41. Each sub-guide G12 defines a length L2 in a direction orthogonal to the third direction that is greater than a length L1 of the corresponding main guide G11 in the direction orthogonal to the third direction (refer to FIGS. 5A and 7). Each second protrusion C2 has a diameter smaller than a diameter of each third protrusion C3. With this configuration, in the direction orthogonal to the third direction, each sub-guide G12 and the corresponding second protrusion C2 provides a clearance therebetween that is greater than a clearance provided between each main guide G11 and the corresponding third protrusion C3. In other words, in the direction orthogonal to the third direction, each sub-guide G12 and the corresponding second protrusion C2 provides a maximum distance therebetween that is greater than a maximum distance defined between each main guide G11 and the corresponding third protrusion C3. As illustrated in FIG. 5B, in a state where one of the developing cartridges 60 is attached to the support member 90, the attached developing cartridges 60 is pivotable about the third protrusions C3 (more specifically, about an axis defined by the pair of third protrusions C3).

The support member 90 also includes cartridge pressing portions 100 each configured to press the developing cartridges 60 toward the corresponding photosensitive drums 41. In FIGS. 5A to 5C, for the sake of convenience, the cartridge pressing portions 100 are depicted as being disposed outward of the side wall 93 in the left-right direction. However, the cartridge pressing portions 100 are actually disposed inward of the side wall 93 in the left-right direction.

Each cartridge pressing portion 100 includes a lever 110, and a spring 120 urging the lever 110. The lever 110 is pivotably supported by the side wall 93.

Each lever 110 includes a pivot shaft portion 111, a first arm portion 112, a second arm portion 113, a first pressing portion 114, and a second pressing portion 115. The pivot shaft portion 111 is disposed at a position rearward of an upper end portion of the corresponding main guide G11.

In the state where the support member 90 is at the separation position (i.e., in the state shown in FIG. 5A), the first arm portion 112 extends from the pivot shaft portion 111 toward a bottom end of the support member 90. A portion of the first arm portion 112 is located in the corresponding main guide G11 in a side view. In the state where the support member 90 is at the separation position, the second arm portion 113 extends from the pivot shaft portion 111 toward a rear end of the support member 90. The spring 120 has one end coupled to a rear end portion of the second arm portion 113. Another end of the spring 120 is connected to the side wall 93.

In the state where the support member 90 is at the separation position, the first pressing portion 114 extends from a bottom end of the first arm portion 112 toward the rear end of the support member 90. In the state where the support member 90 is at the separation position, the second pressing portion 115 extends from a rear end of the first pressing portion 114 toward the bottom end of the support member 90.

In a state where the support member 90 is at the exposure position (depicted in FIG. 10), the first pressing portions 114 press the corresponding second protrusions C2. In the state where the support member 90 is at the separation position, the first pressing portions 114 nip the corresponding second protrusions C2 with the bottom surfaces F1 of the corresponding sub-guides G12, as illustrated in FIG. 5C. In the state where the support member 90 is at the separation position, the second pressing portions 115 serve as stoppers to prevent the levers 110 from coming off the corresponding second protrusions C2.

The springs 120 are tension coil springs, for example. The springs 120 urge the corresponding second arm portions 113 to pull the rear end portions of the second arm portions 113 diagonally downward. In the state illustrated in FIG. 5A, each spring 120 has a natural length thereof. Alternatively, for example, in a configuration where stoppers (not illustrated) may be provided to restrict the levers 110 from pivoting clockwise from the position illustrated in FIG. 5A, the levers 110 may be normally urged by the springs 120.

Figure 6:
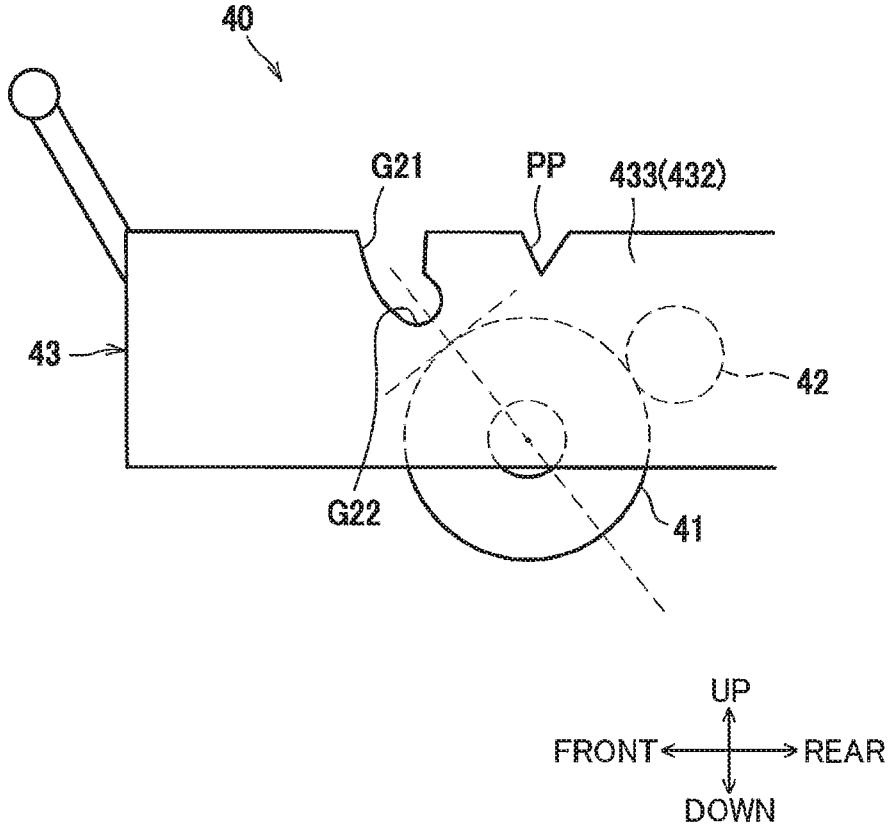
FIG. 6 is a side view illustrating part of the drum unit according to the first embodiment.

As illustrated in FIG. 6, the drum frame 43 of the drum unit 40 includes first guides G21 and the second guides G22. Each first guide G21 extends in the upper-lower direction. Each second guide G22 extends in the second direction different from the upper-lower direction. The first guides G21 and the second guides G22 are configured to guide the first protrusions C1 of the corresponding developing cartridges 60 while the support member 90 supporting the developing cartridges 60 moves from the separation position to the exposure position. The first guides G21 and the second guides G22 are also configured to guide the corresponding first protrusions C1 while the developing cartridges 60 are being attached to the support member 90 at the exposure position and to the drum unit 40 positioned below the support member 90.

The first guides G21 are grooves formed in the side wall 433 of the drum frame 43. The first guides G21 are open upward. Each first guide G21 has a width in the front-rear direction that becomes wider toward upward. Incidentally, since the left side wall 432 and the right side wall 433 have similar structures to each other, only the right side wall 433 will be described and a description for the left side wall 432 will be omitted for simplifying description.

The second guides G22 are grooves formed in the side wall 433 of the drum frame 43. The second guides G22 are configured to guide the first protrusions C1 of the developing cartridges 60 toward the corresponding photosensitive drums 41 after the first protrusions C1 are guided by the first guides G21. Specifically, each second guide G22 extends diagonally rearward and downward from a bottom end of the corresponding first guide G21.

Each second guide G22 extends in the second direction, i.e., along a normal line that is normal to the peripheral surface of the corresponding photosensitive drum 41 (see FIG. 6). In other words, as viewed in the second direction, each second guide G22 overlaps with a rotational center of the corresponding photosensitive drum 41.

Figure 7:
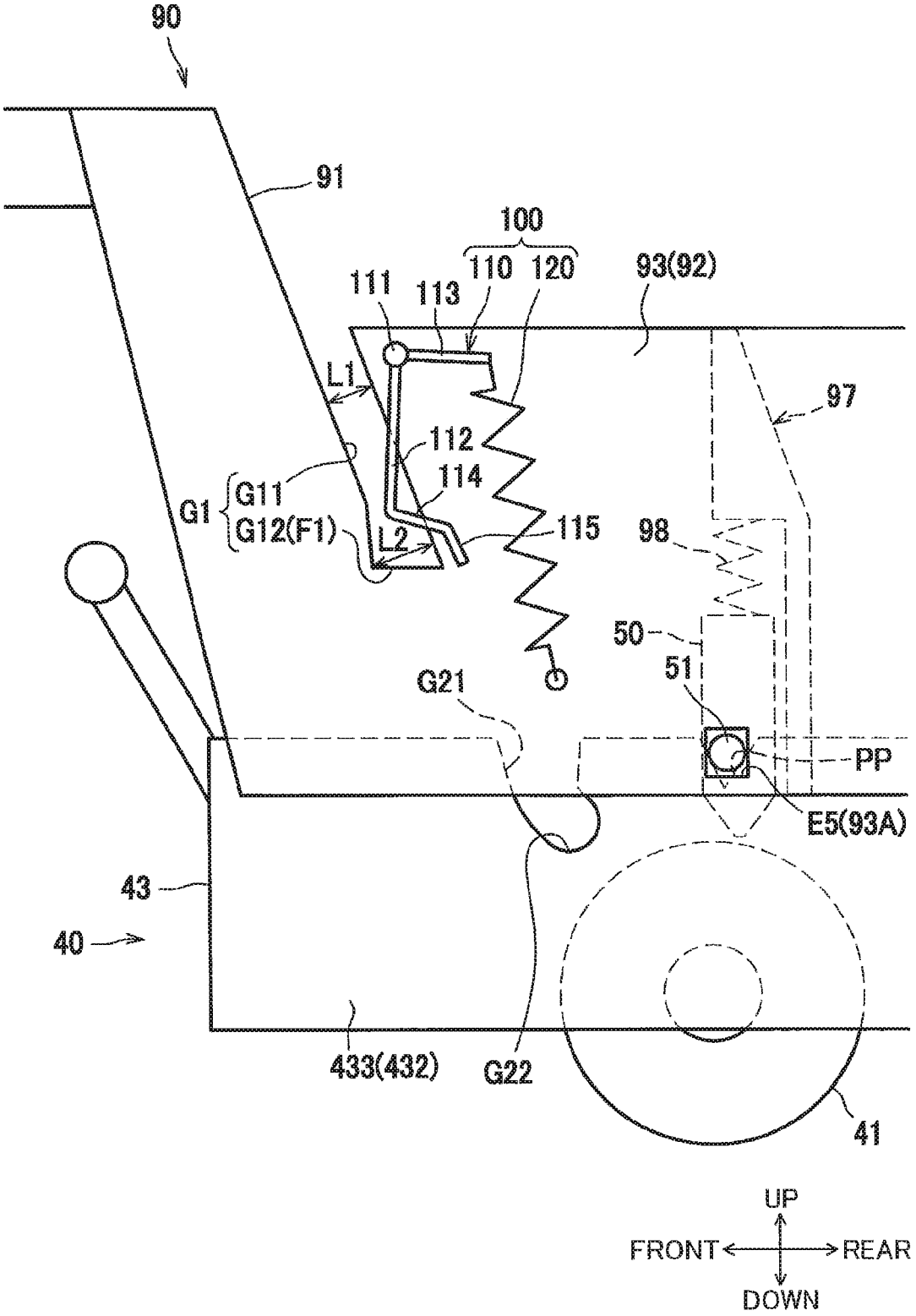
FIG. 7 is a partially-enlarged side view schematically illustrating the drum unit and the support member according to the first embodiment in a state where the support member is at an exposure position thereof.

The side wall 433 of the drum frame 43 also includes notches PP serving to fix positions of the exposure heads 50. Each notch PP has a V shape in a side view. As illustrated in FIG. 7, when the support member 90 is at the exposure position, the notches PP are in contact with the protrusions 51 of the respective exposure heads 50. At this time, the protrusions 51 of the exposure heads 50 are respectively spaced away from the one ends E5 of the grooves 93A.

More specifically, in a process of moving the support member 90 from the separation position to the exposure position, the protrusions 51 supported by the one ends E5 of the respective grooves 93A come into contact with the notches PP, respectively. The contact against the notches PP restrict the protrusions 51 from moving further downward. As the support member 90 is moved further downward thereafter, the one ends E5 of the grooves 93A move downward away from the protrusions 51, respectively. Hence, in the state where the support member 90 is at the exposure position, the protrusions 51 are separated upward away from the one ends E5 of the respective grooves 93A.

When the support member 90 is at the exposure position, the support member 90 and the first guides G21 overlap with each other as viewed in the left-right direction, i.e., the axial direction of each photosensitive drum 41 (see FIGS. 7-10). More specifically, the left and right side walls 92 and 93 of the support member 90 are disposed farther outward relative to the left and right side walls 432 and 433 of the drum frame 43 in the left-right direction. Note that the front wall 91 of the support member 90 may be formed with notches for preventing interference with the left and right side walls 432 and 433 of the drum frame 43, for example, as appropriate.

Figure 8:
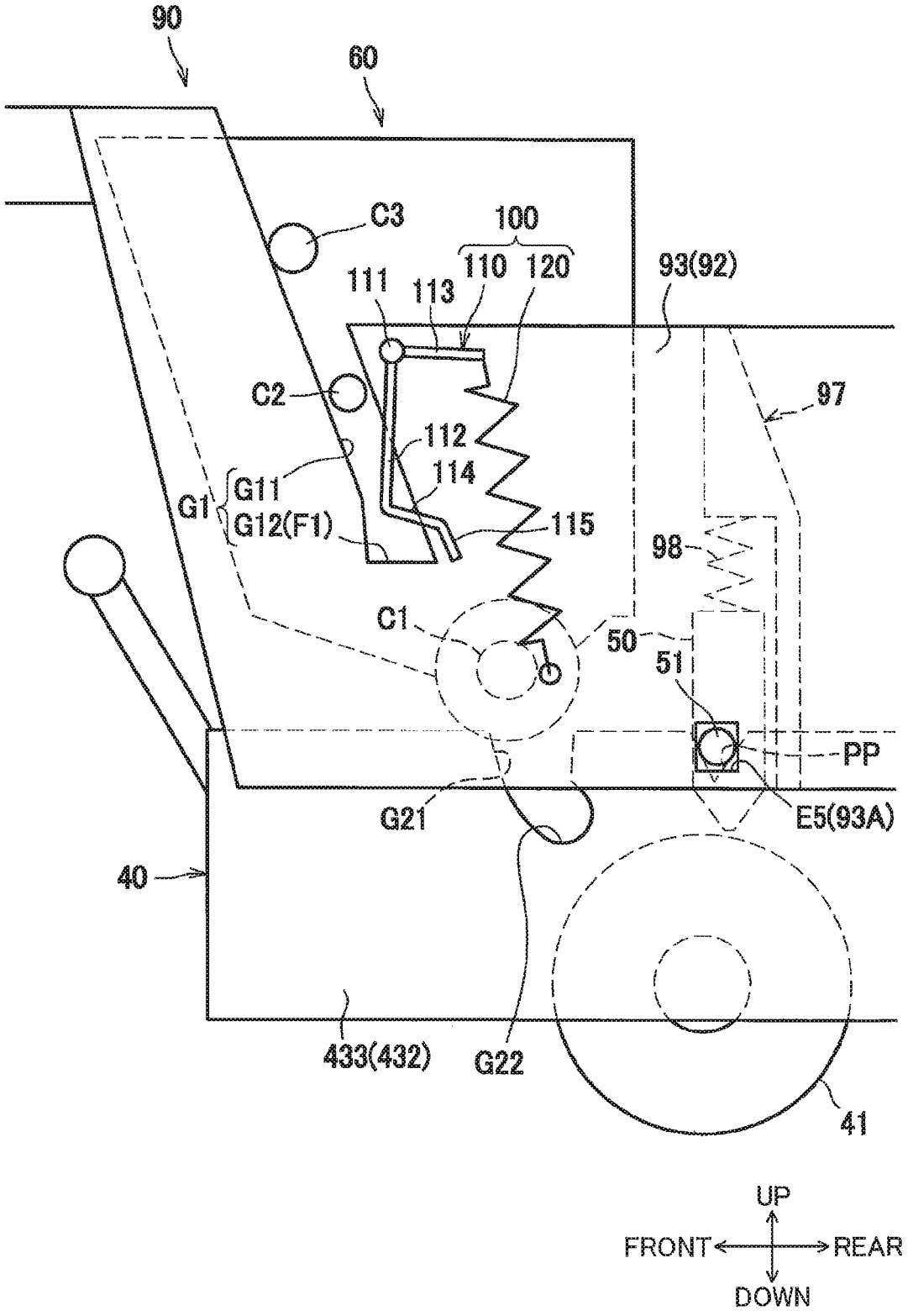
FIG. 8 is a partially-enlarged side view schematically illustrating a state where the developing cartridge is being attached to the support member according to the first embodiment in the state where the support member is at its exposure position.

As illustrated in FIG. 8, tip ends of the respective first protrusions C1 are positioned inward relative to the left and right side walls 92 and 93 of the support member 90 in the left-right direction, so that the first protrusions C1 can engage with the corresponding first guides G21 and the second guides G22. Further, the second protrusions C2 and the third protrusions C3 of the developing cartridges 60 protrude farther outward relative to the first protrusions C1 in the left-right direction, so that the second protrusions C2 and the third protrusions C3 can engage with the corresponding cartridge guides G1 formed in the left and right side walls 92 and 93 of the support member 90.

Figure 9:
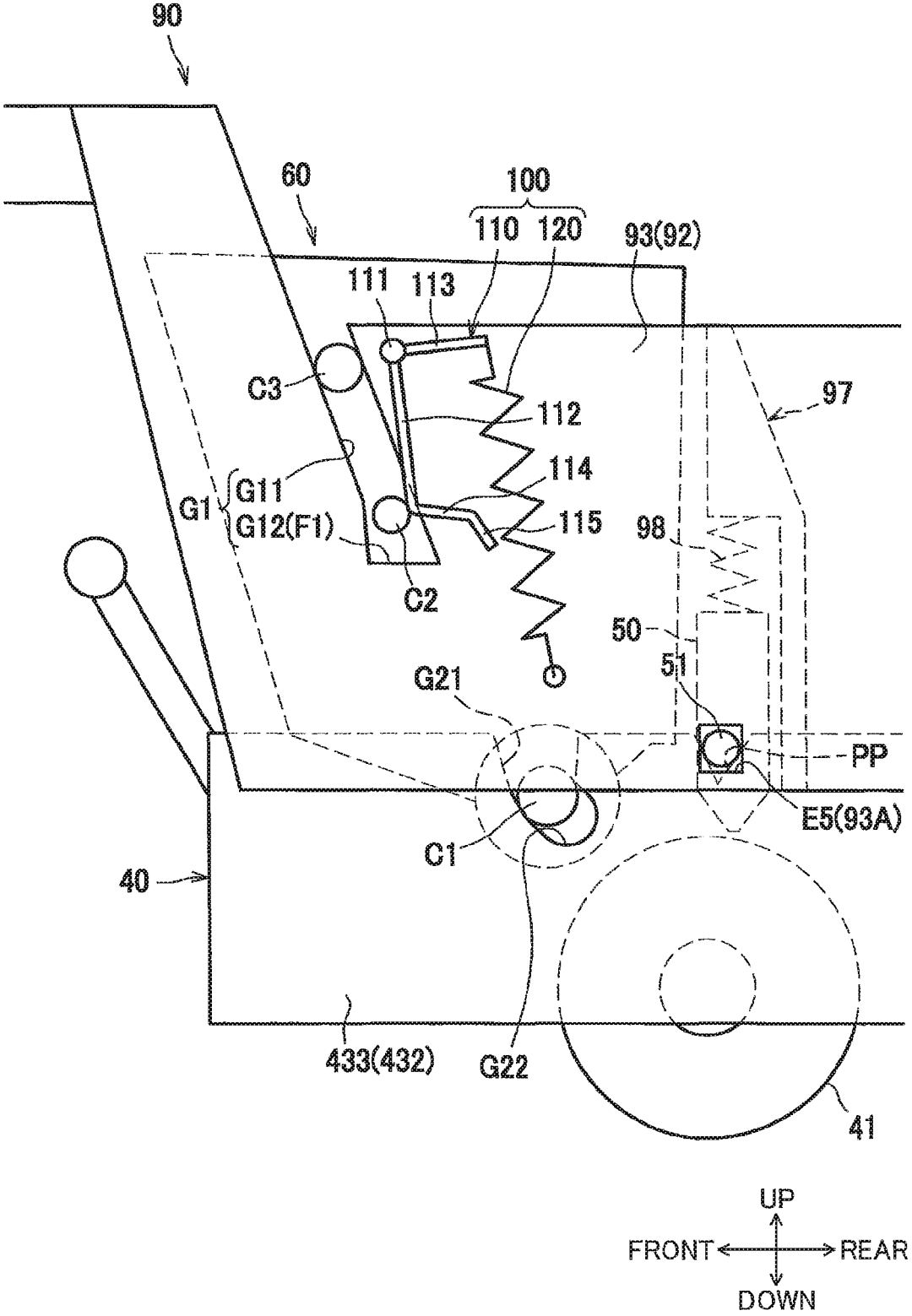
FIG. 9 is a partially-enlarged side view schematically illustrating a state of the developing cartridge and the support member according to the first embodiment after the state depicted in FIG. 8, and illustrating a state where a first protrusion of the developing cartridge is located at an entrance of the sub-guide of the support member according to the first embodiment.
Figure 10:
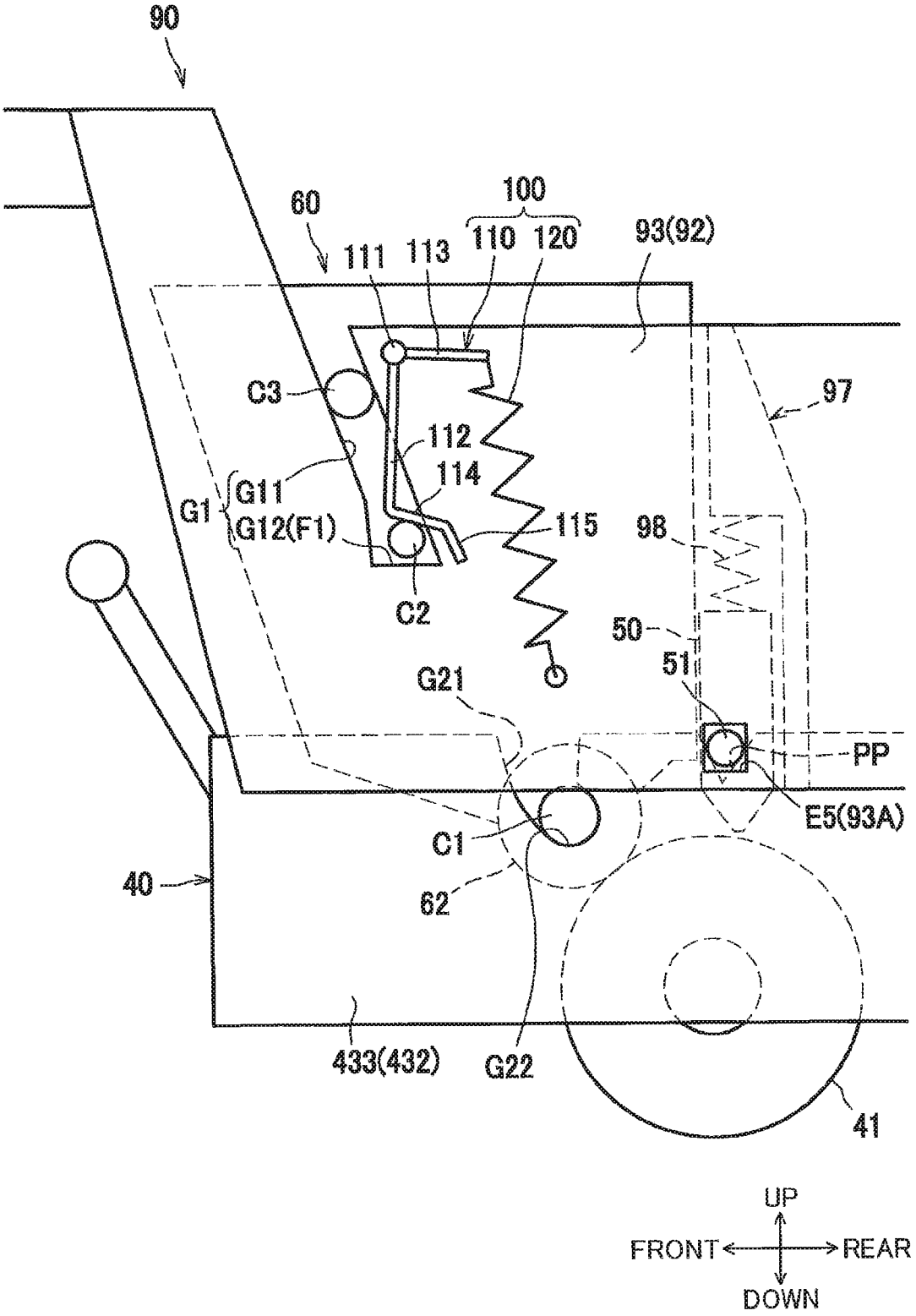
FIG. 10 is a partially-enlarged side view schematically illustrating a state of the developing cartridge and the support member according to the first embodiment after the state depicted in FIG. 9, and illustrating a state where the first protrusion of the developing cartridge located in the sub-guide of the support member according to the first embodiment.

As illustrated in FIGS. 9 and 10, while the first protrusions C1 are located in the second guides G22, the second protrusions C2 are positioned in the sub-guides G12 and the third protrusions C3 are positioned in the main guides G11. As illustrated in FIG. 10, when the support member 90 to which the developing cartridges 60 are attached is at the exposure position, the second protrusions C2 are in contact with the levers 110 and spaced away from the bottom surfaces F1 of the sub-guides G12.

Figure 11:
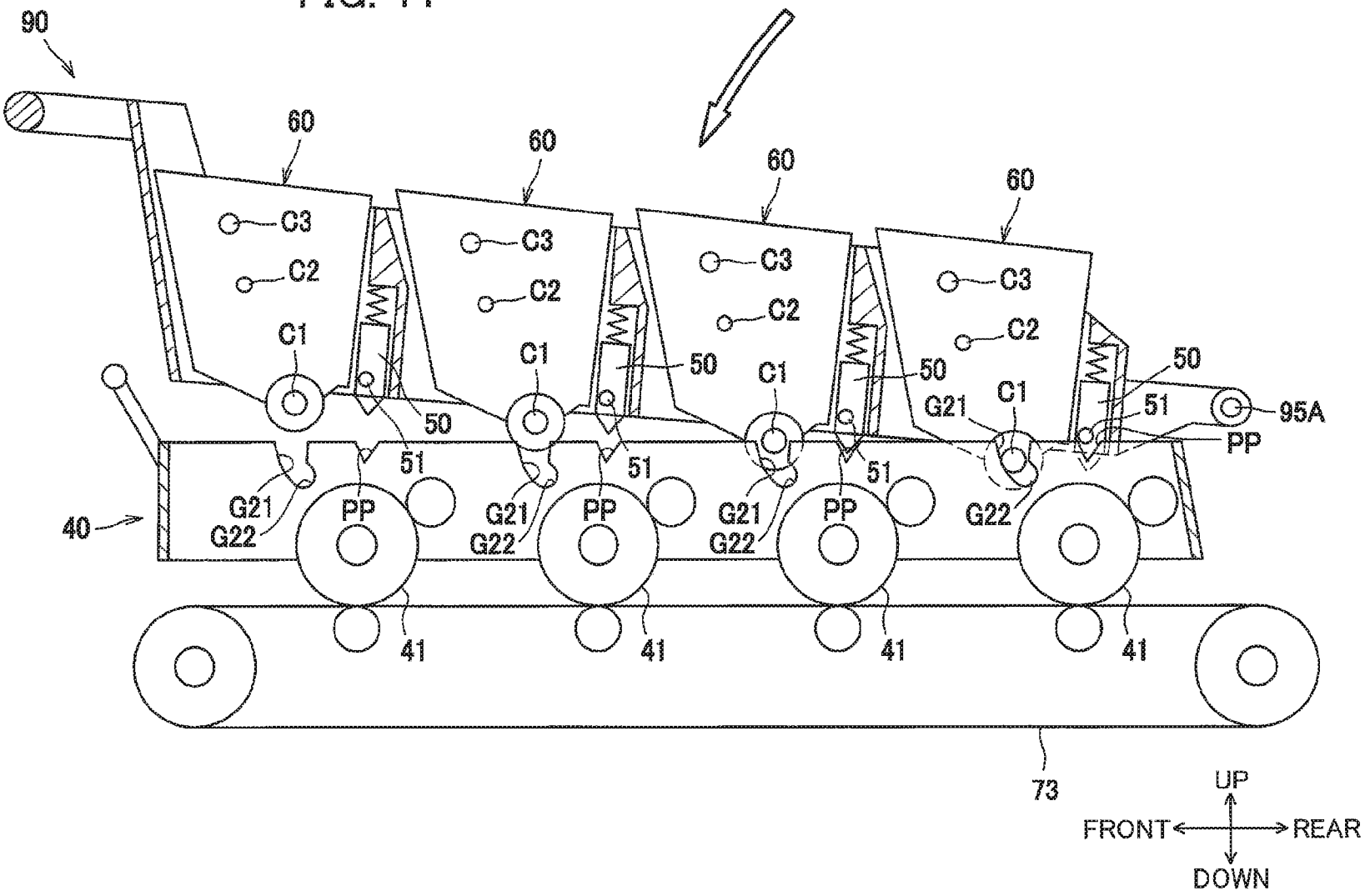
FIG. 11 is a schematic cross-sectional view illustrating a state of the support member according to the first embodiment is being pivoted from a separation position thereof toward the exposure position.

Furthermore, as illustrated in FIG. 11, in a process of pivoting the support member 90 having the developing cartridges 60 attached thereto from the separation position to the exposure position, the pair of the first protrusions C1 positioned closest to the pivot center of the support member 90 (i.e., the pivot shaft 95A) comes into contact with the corresponding first guides G21 before the remaining three pairs of first protrusions C1 come into contact with the corresponding first guides G21. With this configuration, while the support member 90 (including the developing cartridges 60) is being pivoted downward toward the exposure position, the developing cartridge 60 positioned closest to the pivot center of the support member 90 (pivot shaft 95A) is caused to pivot before the remaining three developing cartridges 60 are caused to pivot. Accordingly, in the process of pivoting the support member 90 from the separation position to the exposure position, the plurality of second protrusions C2 are caused to be separated away from the bottom surfaces F1 of the corresponding sub-guides G12 sequentially in an order starting from the pair of second protrusions C2 positioned closest to the pivot center of the support member 90 (refer to FIGS. 5B and 5C).

Operations and technical advantages of the support member 90 and the drum unit 40 according to the first embodiment will be described next.

As illustrated in FIG. 8, when the developing cartridges 60 are inserted into the support member 90 at the exposure position, the second protrusions C2 and the third protrusions C3 are first guided by the corresponding main guides G11. Since each second protrusion C2 and each third protrusion C3 are guided by the corresponding main guide G11 in this way, the developing cartridges 60 can be inserted in the support member 90 while being maintained in a certain posture by the main guides G11.

The first protrusions C1 of the developing cartridges 60 are then inserted into the corresponding first guides G21 of the drum unit 40, and guided toward the second guides G22 by the first guides G21. As illustrated in FIG. 9, when the first protrusions C1 arrive at the second guides G22 and are positioned at entrances (upper ends) of the corresponding second guides G22, the second protrusions C2 are positioned in the sub-guides G12 while the third protrusions C3 are positioned in the main guides G11. In this state, each developing cartridge 60 is pivotable about (axes of) the third protrusions C3 thereof.

While moving along the main guides G11, the second protrusions C2 cause the levers 110 to pivot counter-clockwise against urging forces of the springs 120. As the second protrusions C2 move downward past junctions of the levers 110 between the first arm portions 112 and the first pressing portions 114, the levers 110 are caused to pivot clockwise by the urging forces of the springs 120, thereby placing the first pressing portions 114 on the second protrusions C2.

When the developing cartridges 60 are pressed further downward, the first protrusions C1 are guided diagonally rearward and downward by the corresponding second guides G22. The developing cartridges 60 are thus caused to pivot counter-clockwise about (the axes of) the third protrusions C3 thereof. Since the developing cartridges 60 are pivotable about the third protrusions C3 thereof, the first protrusions C1 can move smoothly along the second guides G22.

When the developing rollers 62 of the developing cartridges 60 are respectively in contact with the photosensitive drums 41 as depicted in FIG. 10, the first pressing portions 114 of the levers 110 press the corresponding second protrusions C2 downward. The first protrusions C1 are thus pressed diagonally downward and rearward along the second guides G22, causing the developing rollers 62 to be pressed against the corresponding photosensitive drums 41. Incidentally, in order to remove the developing cartridges 60 from the support member 90, the operations described above may be performed in reverse.

As illustrated in FIG. 11, while the support member 90 supporting the developing cartridges 60 is being pivoted from the separation position to the exposure position, the pair of the first protrusions C1 positioned closest to the pivot shaft 95A comes into contact with the corresponding first guides G21 before remaining three pairs of the first protrusions C1 come into contact with the corresponding first guides G21. With this configuration, as the support member 90 is being pivoted from the separation position to the exposure position, the four pairs of second protrusions C2 are sequentially separated away from the bottom surfaces F1 of the corresponding sub-guides G12 in an order starting from the pair of second protrusions C2 positioned closest to the pivot shaft 95A (from the state depicted in FIG. 5C to the state depicted in FIG. 5B).

Similarly, as the support member 90 is being pivoted from the separation position to the exposure position, the protrusions 51 of the exposure heads 50 sequentially come into contact with the notches PP of the drum unit 40 in an order starting from the pair of protrusions 51 positioned closest to the pivot shaft 95A. With this configuration, in the process of pivoting the support member 90 from the separation position to the exposure position, the four pairs of protrusions 51 are sequentially separated away from the one ends E5 of the corresponding grooves 93A in an order starting from the pair of protrusions 51 positioned closest to the pivot shaft 95A (refer to FIG. 7).

With the structure according to the first embodiment described above, the following technical advantages can be achieved.

In the above embodiment, the drum unit 40 is formed with curved guides, i.e., the first guides G21 and the second guides G22 extending in directions different from each other. However, even in a state where the first protrusions C1 are positioned in the second guides G22, the second protrusions C2 are positioned in the sub-guides G12 of the first guides G21 and the third protrusions C3 are positioned in the main guides G11 of the first guides G21. With this structure, the first protrusions C1 and the second protrusions C2 can be pivoted about the third protrusions C3. The first protrusions C1 can be therefore smoothly moved along the second guides G22 extending in the second direction different from an extending direction of the first guides G21. Reliable positioning of the developing cartridges 60 relative to the photosensitive drums 41 can be obtained.

When the support member 90 is at the separation position, each second protrusion C2 is nipped between the corresponding lever 110 and sub-guide G12. The developing cartridges 60 can be thus suppressed from rattling relative to the support member 90 at the separation position.

In the state where the support member 90 is at the exposure position, the second protrusions C2 are separated away from the bottom surfaces F1 of the corresponding sub-guides G12 while being in contact with the corresponding levers 110. The developing rollers 62 of the developing cartridges 60 can thus be readily pressed against the photosensitive drums 41.

While the support member 90 is pivoted from the separation position to the exposure position, the second protrusions C2 are caused to be sequentially separated from the bottom surfaces F1 of the corresponding sub-guides G12 in an order from the pair of second protrusions C2 positioned closest to the pivot center of the support member 90 (pivot shaft 95A). This structure can gradually increase counter force transmitted from the support member 90 to the user, thereby improving operability of the support member 90.

Still further, when the support member 90 is at the separation position, the exposure heads 50 pressed downward by the corresponding head pressing members 98 are in contact with the one ends E5 of the corresponding grooves 93A. Hence, rattling of the exposure heads 50 can be restrained while the support member 90 is at the separation position.

Further, the notches PP of the drum unit 40 can receive the respective exposure heads 50 to provide positioning of the exposure heads 50. This structure can provide accurate positioning of the exposure heads 50 relative to the photosensitive drums 41. Also, when the support member 90 is at the exposure position, the exposure heads 50 are respectively in contact with the notches PP, while being spaced away from the one ends E5 of the corresponding grooves 93A. With this structure, the head pressing members 98 can reliably press the corresponding exposure heads 50 against the notches PP.

Further, the opposing surface 52 of each exposure head 50 is arranged orthogonal to the front-rear direction and parallel to the opposing surface 60F of the corresponding developing cartridge 60. This structure of the first embodiment can lead to increase in capacity of each developing cartridge 60, compared to a structure where the opposing surface 60F of the developing cartridge 60 is slanted relative to the opposing surface 52 of the corresponding exposure head 50, for example.

The first walls 97 are joined to the two side walls 92 and 93. Rigidity of the support member 90 can be enhanced.

Figure 3:
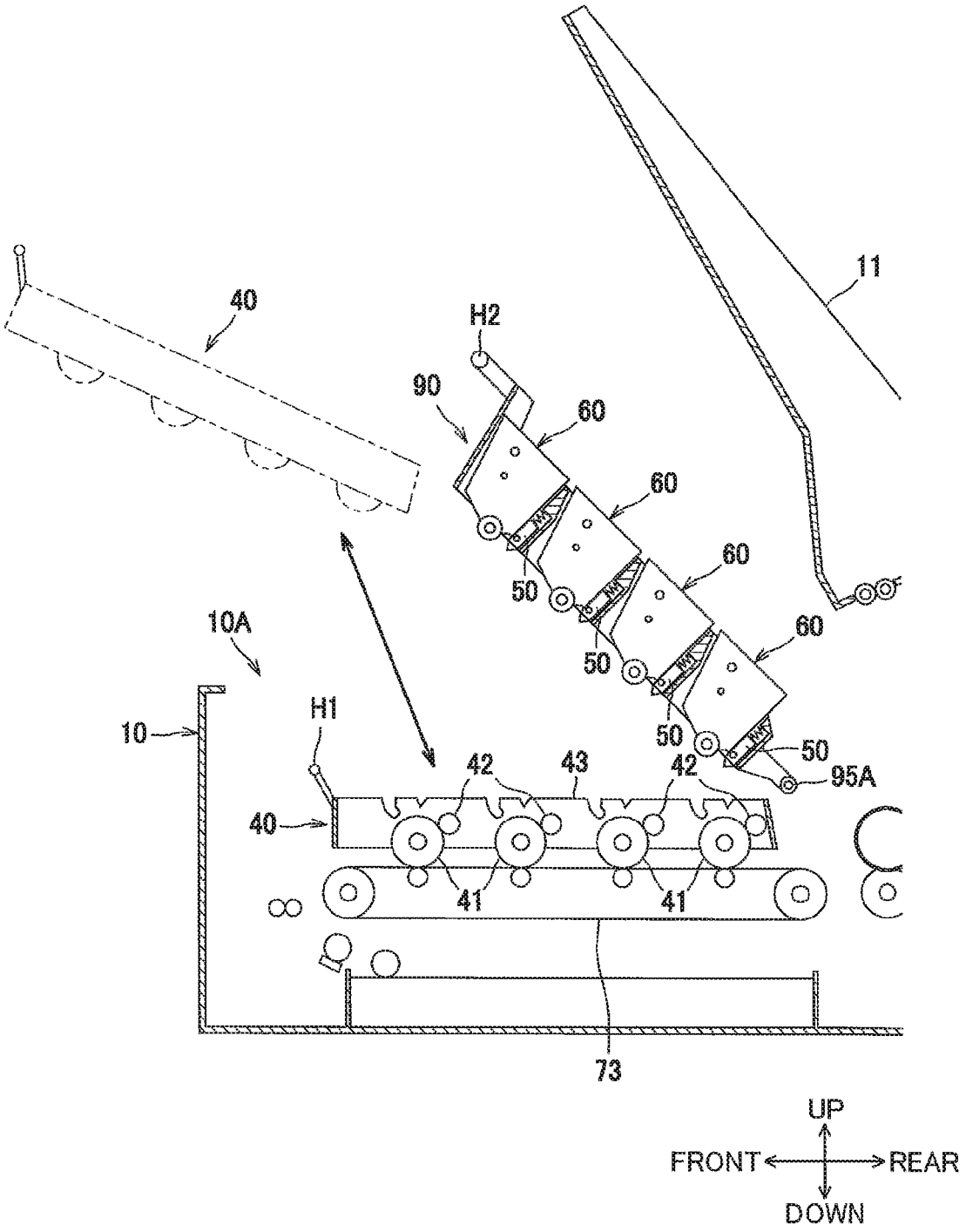
FIG. 3 is a schematic cross-sectional view of the color printer according to the first embodiment in a state where a drum unit is removed from a main casing.

Further, in the depicted first embodiment, an entirety of the drum unit 40 supporting the four photosensitive drums 41 can be removed from the main casing 10 as depicted in FIG. 3 while the support member 90 is at the separation position. This structure can facilitate user's removal of a jammed sheet P from the conveyor belt 73 at the time of occurrence of a paper jam over the conveyor belt 73, compared to a case where four drum units (each including a photosensitive drum) need to be removed independently, one by one, from a conveyor belt in case of a paper jam (see the conventional structure disclosed by Japanese Patent Application No. 2013-134371, for example). Detachment of the drum unit 40 as a whole from the main casing 10 can relieve user's burden involved in dealing with a paper jam.

It would be apparent to those skilled in the art that various modifications and variations may be made in the depicted first embodiment. Hereinafter, like parts and components are designated with the same reference numerals as the first embodiment in order to avoid duplicating description.

In the first embodiment, the length L2 of the sub-guide G12 in the direction orthogonal to the third direction is greater than the length L1 of the main guide G11 in the direction orthogonal to the third direction; and the diameter of the second protrusion C2 is smaller than the diameter of the third protrusion C3. However, other configurations may be available, provided that a clearance between the sub-guide G12 and the second protrusion C2 in the direction orthogonal to the third direction is greater than a clearance between the main guide G11 and the third protrusion C3 in the direction orthogonal to the third direction. For an example, the sub-guide G12 and the main guide G11 may have the same length as each other, while the diameter of the second protrusion C2 may be made smaller than the diameter of the third protrusion C3. Alternatively, the length L2 of the sub-guide G12 in the direction orthogonal to the third direction may be made greater than the length L1 of the main guide G11 in the direction orthogonal to the third direction, while the diameter of the second protrusion C2 may be equal to or greater than the diameter of the third protrusion C3.

In the first embodiment, the lever 110 and the spring 120 (tension coil spring) are used as an example of an urging member of the disclosure. However, the urging member may be a leaf spring or a torsion spring, or may be a combination of a lever and a compression spring.

Likewise, in the first embodiment, the head pressing member 98 (tension coil spring) are used as an example of a pressing member of the disclosure. However, the pressing member may be a compression spring other than a tension coil spring, such as a leaf spring or a torsion spring. Alternatively, the pressing member may be a tension spring or an extension spring.

Further, in the depicted first embodiment, four of the photosensitive drums 41 are provided in the drum unit 40, and four of the exposure heads 50 and four developing cartridges 60 are provided at the support member 90. However, the number of photosensitive drums, exposure heads, and developing cartridges provided at the photosensitive drum 41 and drum unit 40 need not be limited to four, but may be one each, or may be a plural number other than four.

Figure 12:
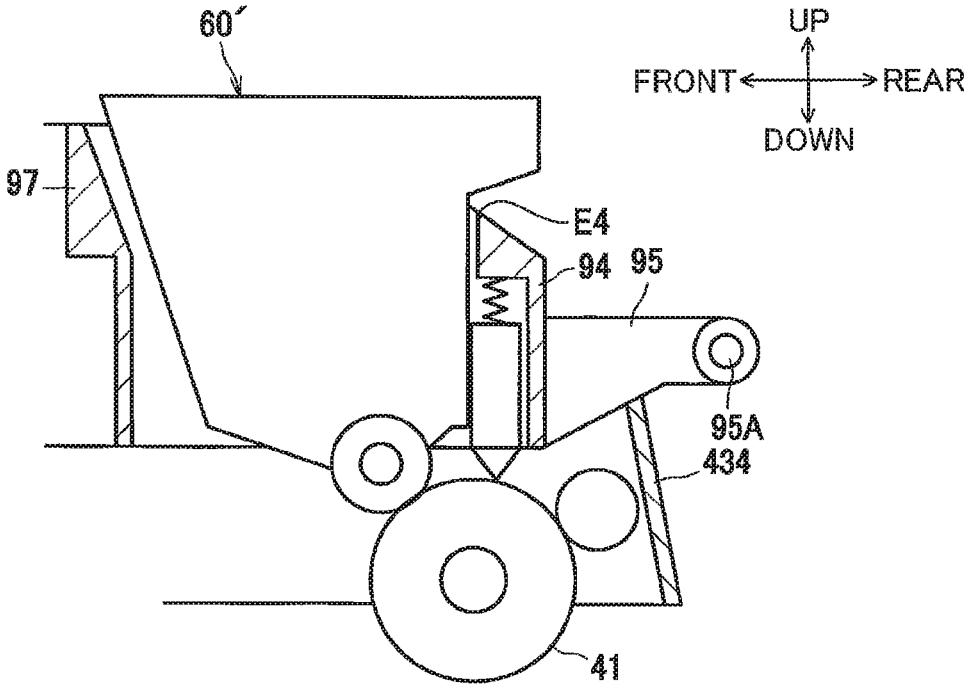
FIG. 12 is a partial cross-sectional view schematically illustrating a structure of a developing cartridge according to a variation of the first embodiment.

In the first embodiment described above, the four developing cartridges 60 have the same capacity as each other. However, the four developing cartridges 60 need not necessarily have the same capacity as each other. For example, as illustrated in FIG. 12, among the four developing cartridges 60, one of the developing cartridges 60 positioned closest to the pivot center (pivot shaft 95A) of the support member 90 (labelled with a reference number 60') may have a capacity greater than the capacity of the remaining three developing cartridges 60.

More specifically, since the upper end of the rear wall 94 (fourth end E4) is lower than the upper ends of the first walls 97 as described above, the developing cartridge 60' positioned frontward of the rear wall 94 may have an upper portion that is extended rearward farther than the upper end (fourth end E4) of the rear wall 94, while an upper surface of the developing cartridge 60' is maintained at the same height as the other developing cartridges 60. The developing cartridge 60' positioned closest to the pivot shaft 95A of the support member 90 among the four developing cartridges 60 is adapted for accommodating black developer. This configuration of FIG. 12 can increase the capacity of the developing cartridge 60' that accommodates the black developer which is expected to be used most among the four colors of developer, thereby improving user's convenience.

Figure 13:
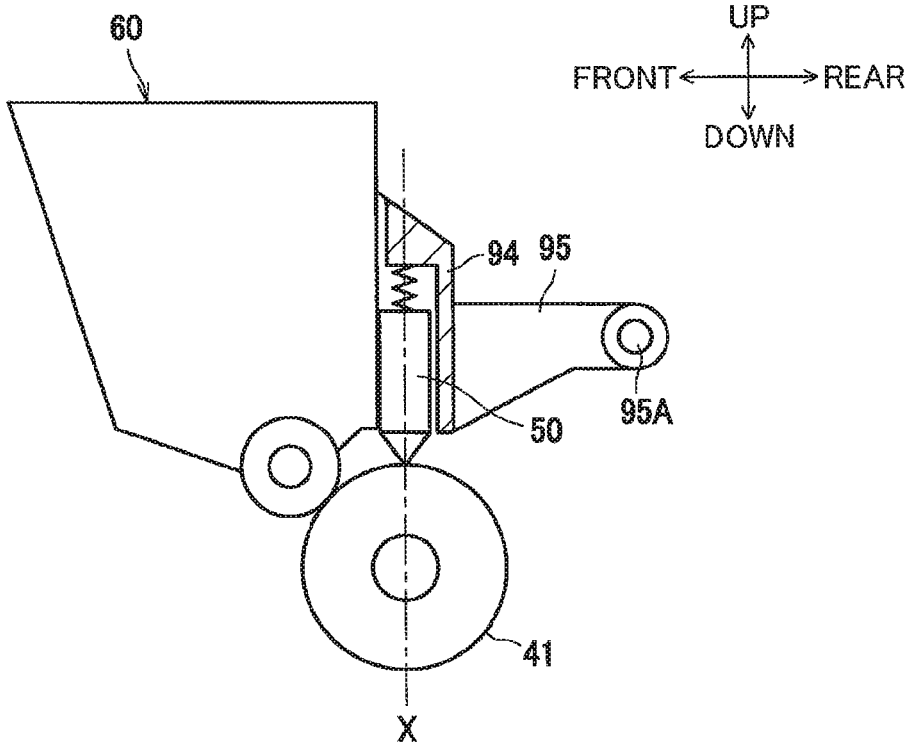
FIG. 13 is a partial cross-sectional view schematically illustrating a structure of an exposure head according to another variation of the first embodiment.

Still further, as depicted in FIG. 13, the exposure heads 50 may be arranged each to define an optical axis X that extends along the normal line that is normal to the peripheral surface of the corresponding photosensitive drum 41. More specifically, each exposure head 50 may be disposed so that an extension line of the optical axis thereof passes through the rotational center of the corresponding photosensitive drum 41. With this configuration, the beam from the exposure head 50 can be irradiated with a perfect-circular shape in diameter on the peripheral surface of the photosensitive drum 41. Hence, improved image quality can be obtained.

Second Embodiment

Next, a color printer 201 according to a second embodiment will be described while referring to FIGS. 14 to 19. Hereinafter, like parts and components are designated with the same reference numerals as the first embodiment in order to avoid duplicating description.

The color printer 201 according to the second embodiment includes a drum unit 240 and a support member 290, instead of the drum unit 40 and support member 90 of the first embodiment. The color printer 201 is different from the color printer 1 of the first embodiment in that the color printer 201 further includes a structure for positioning the drum unit 240 relative to a main casing 210 of the color printer 201. Hereinafter, the structures for providing positioning of the drum unit 240 relative to the main casing 210 will be described.

Figure 14:
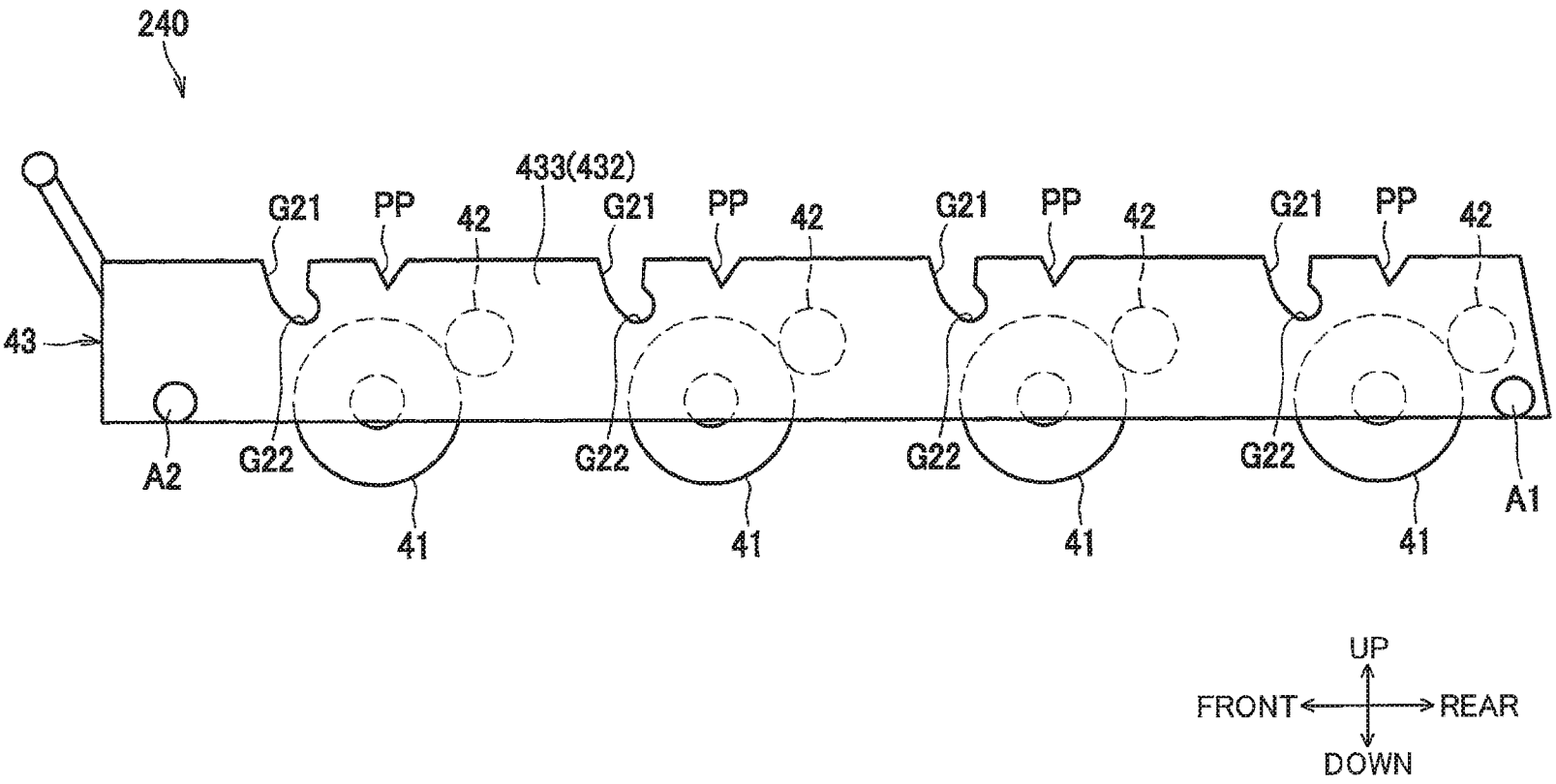
FIG. 14 is a side view of a drum unit according to a second embodiment of the disclosure.
Figure 15:
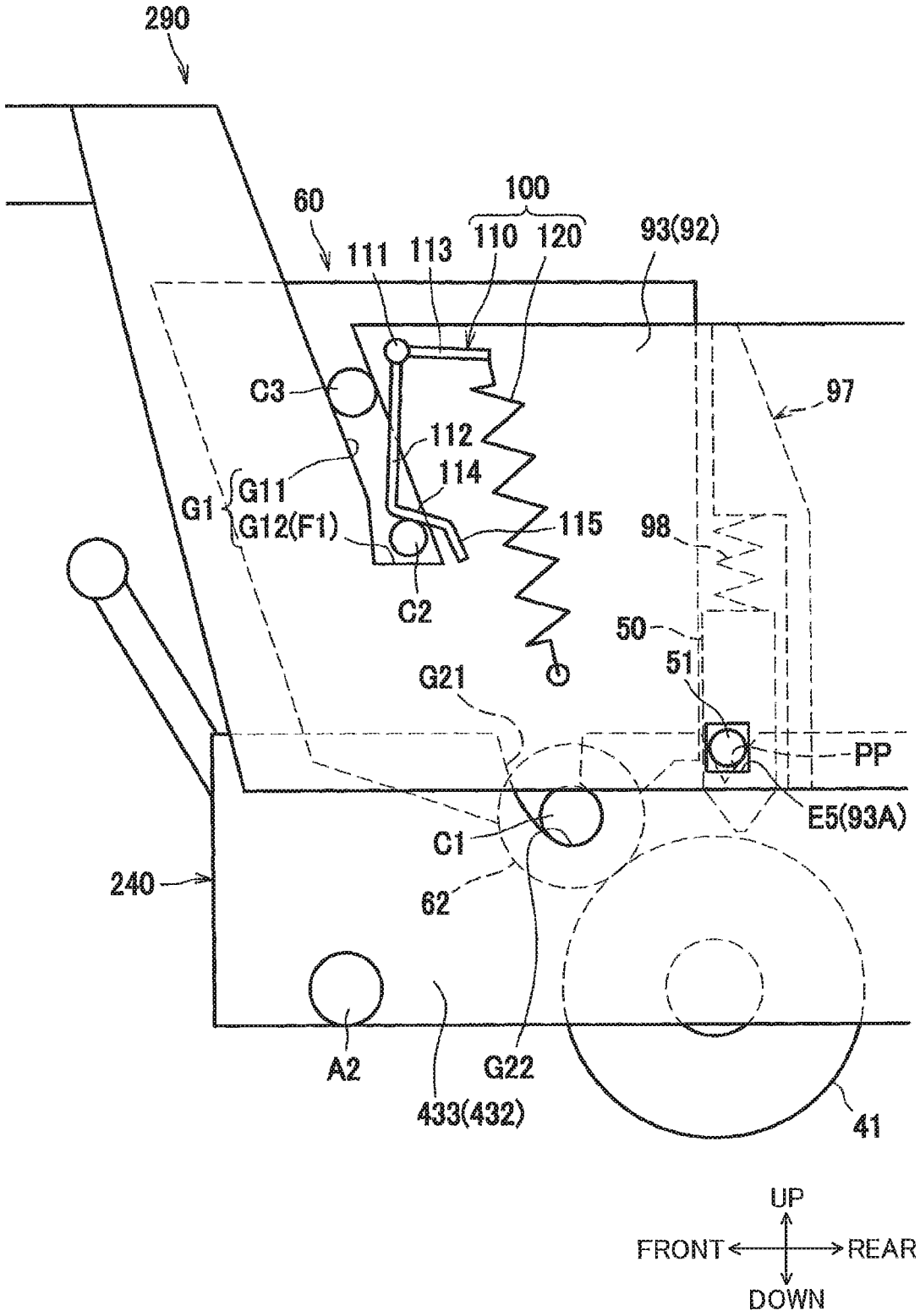
FIG. 15 is a partially-enlarged side view schematically illustrating the drum unit and a support member according to the second embodiment in a state where the support member is at its exposure position.

Referring to FIG. 14, the drum unit 240 includes a reference shaft A1 and a pressing-target portion A2 provided at the side wall 433 of the drum frame 43. The reference shaft A1 is used for positioning the drum unit 240 relative to the main casing 210. The pressing-target portion A2 is used for being pressed by a second pressing member P2 (described later) of the main casing 210. Note that the reference shaft A1 and the pressing-target portion A2 are also provided at the left side wall 432 of the drum frame 43 in a similar manner Descriptions therefor will be omitted.

The reference shaft A1 is a columnar-shaped protrusion. The reference shaft A1 is disposed at a lower-rear end portion of the side wall 433. The reference shaft A1 protrudes outward in the left-right direction from the side wall 433.

The pressing-target portion A2 is a columnar-shaped protrusion. The pressing-target portion A2 is disposed at a lower-front end portion of the side wall 433. The pressing-target portion A2 protrudes outward in the left-right direction from the side wall 433.

Figure 16:
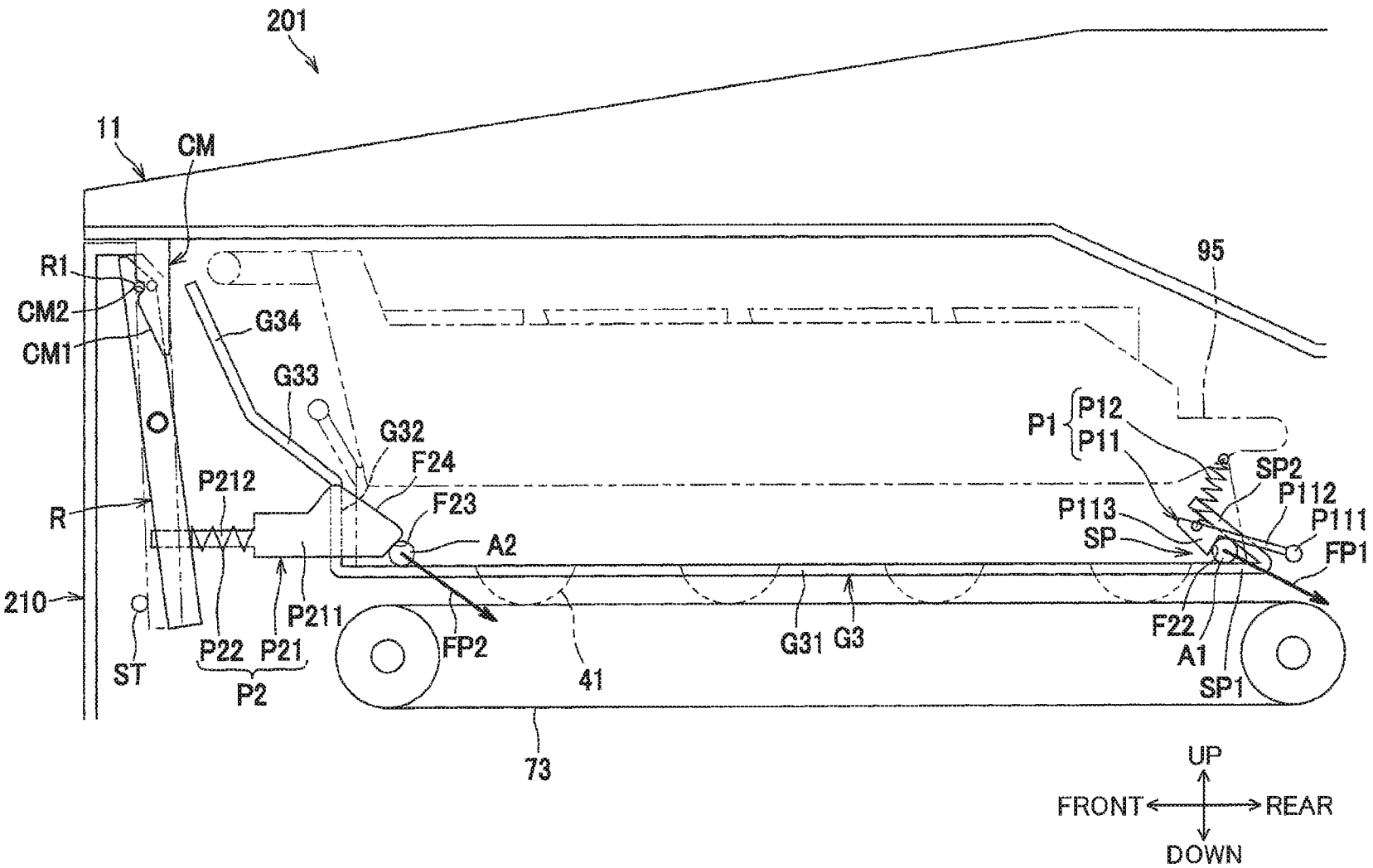
FIG. 16 is an explanatory view illustrating a structure on a left end portion of a main casing according to the second embodiment.

As illustrated in FIG. 16, the main casing 210 includes a pair of positioning portions SP, a pair of main guides G3, a pair of first pressing members P1, a pair of the second pressing members P2, and a pair of pivot members R. The positioning portions SP, the main guides G3, the first pressing members P1, the second pressing members P2, and the pivot members R are provided one each beside each end of the drum unit 240 in the left-right direction i.e., the axial direction of each photosensitive drum 41. Hereinafter, a structure on a left side of the main casing 210 will be described, while a description for a structure on a right side of the main casing 210 will be omitted as the structure on the right side is similar to the structure on the left side.

The positioning portions SP serve to fix the position of the drum unit 240 in the prescribed direction, i.e., the front-rear direction relative to the main casing 210. The positioning portions SP are integrally formed with the respective main guides G3. Each positioning portion SP is a recessed portion that is open frontward. Specifically, each positioning portion SP includes a horizontal portion SP1 and an inclined portion SP2.

The horizontal portion SP1 is adapted to support the corresponding reference shaft A1 of the drum unit 240 from below. The horizontal portion SP1 extends in the front-rear direction. The horizontal portion SP1 is formed integrally with the corresponding main guide G3.

The inclined portion SP2 is adapted to restrict the corresponding reference shaft A1 from moving rearward. The inclined portion SP2 extends diagonally forward and upward from a rear end of the horizontal portion SP1. The reference shaft A1 is configured to make contact with the inclined portion SP2, by which contact the reference shaft A1 can be fixed in position by the positioning portion SP.

The main guides G3 are adapted to guide the drum unit 240 toward the positioning portions SP during mounting of the drum unit 240 relative to the main casing 210. Each main guide G3 includes a first main guide G31, a second main guide G32, a third main guide G33, and a fourth main guide G34.

The first main guide G31 is adapted to support the corresponding pressing-target portion A2 from beneath. The first main guide G31 extends in the front-rear direction. The first main guide G31 is integrally formed with the horizontal portion SP1. The first main guide G31 extends forward from the horizontal portion SP1.

The second main guide G32 extends upward from a front end of the first main guide G31. The third main guide G33 extends diagonally forward and upward from an upper end of the second main guide G32. The fourth main guide G34 extends diagonally forward and upward from an upper end of the third main guide G33 with an inclination greater than an inclination of the third main guide G33. Specifically, an angle formed by the fourth main guide G34 relative to the horizontal direction is greater than an angle formed by the third main guide G33 relative to the horizontal direction.

The first pressing members P1 and the second pressing members P2 are respectively configured to press the drum unit 240 toward the positioning portions SP. Each first pressing member P1 includes a lock member P11 and a spring P12.

The lock member P11 is disposed at a position offset from the corresponding positioning portion SP in the left-right direction. The lock member P11 is pivotably provided at the main casing 210. The lock member P11 is pivotable between a first position (a position in FIG. 16) and a second position (a position in FIG. 17). At the first position, the lock member P11 closes an opening provided by the positioning portion SP. At the second position, the lock member P11 exposes (opens) the opening of the positioning portion SP. The lock member P11 is at the first position when the support member 290 is at the exposure position, whereas the lock member P11 is at the second position when the support member 290 is at the separation position.

Here, the expression "close the opening of the positioning portion SP" represents a state that the lock member P11 and the opening of the corresponding positioning portion SP overlap with each other as viewed in the axial direction of each photosensitive drum 41 (see FIG. 16). The expression "expose the opening of the positioning portion SP" represents a state that the lock members P11 and the opening of the corresponding positioning portion SP do not overlap with each other as viewed in the axial direction of each photosensitive drum 41 (see FIG. 17).

The lock member P11 includes a shaft portion P111, an arm portion P112, and a claw portion P113. The shaft portion P111 serves as a pivot center of the lock member P11. The shaft portion P111 is supported by the main casing 210 to allow pivotal movement of the lock member P11 relative to the main casing 210. The shaft portion P111 is disposed rearward of the corresponding positioning portion SP.

When the support member 290 is at the exposure position depicted in FIG. 16, the arm portions P112 extends diagonally forward and upward from the shaft portion P111. When the support member 290 is at the exposure position, the claw portion P113 protrudes downward from a front end portion of the arm portion P112.

The claw portion P113 has a contact surface F22 configured to contact the corresponding reference shaft A1 positioned in the positioning portion SP. The contact surface F22 is configured to transmit a pressing force FP1 of the first pressing member P1 to the reference shaft A1. The contact surface F22 is formed to form such an angle that a component in the front-rear direction of the pressing force FP1 of the first pressing member P1 is greater than a component in the upper-lower direction of the pressing force FP1 of the first pressing member P1. That is, the pressing force FP1 of the first pressing member P1 has a component directing in the prescribed direction that is greater than a component directing in the direction orthogonal to the prescribed direction and to the axial direction of each photosensitive drum 41.

The spring P12 is a compression coil spring. The spring P12 is provided at the support member 290. More specifically, the spring P12 has one end coupled to the corresponding extending portion 95 of the support member 290. Another end of the spring P12 is coupled to a tip end portion of the arm portion P112. That is, the other end of the spring P12 is coupled to the lock member P11.

With the first pressing members P1 configured as described above, the support member 290 presses the first pressing members P1 while the support member 290 is pivoted from the separation position to the exposure position. The pressed first pressing members P1 in turn press the drum unit 240. Specifically, while the support member 290 is pivoted from the separation position to the exposure position, the support member 290 presses the lock members P11 via the springs P12. The pressed lock members P11 press the reference shafts A1 against the positioning portions SP.

Further, while the support member 290 is pivoted from the separation position to the exposure position, the first pressing members P1 are configured to come into contact with the drum unit 240 before the exposure heads 50 and the developing cartridges 60 come into contact with the drum unit 240. Specifically, in a process of moving the support member 290 from the separation position to the exposure position, the respective lock members P11 are configured to come into contact with the reference shafts A1 of the drum unit 240 before the protrusions 51 of the exposure heads 50 respectively come into contact with the notches PP of the drum unit 240, and before the first protrusions C1 of the developing cartridges 60 respectively come into contact with the first guides G21 of the drum unit 240.

Each second pressing member P2 includes a moving member P21 and a spring P22. The moving member P21 is movable in the front-rear direction. The spring P22 urges the moving member P21 rearward. The moving member P21 is supported by the main casing 210 so as to be movable in the front-rear direction. The moving member P21 includes a main portion P211 and a support shaft P212.

The main portion P211 has a pressing surface F23 and a pressing-target surface F24. The pressing surface F23 is configured to press the corresponding pressing-target portion A2 supported by the first main guide G31 in a direction diagonally rearward and downward. The pressing-target surface F24 is adapted to be pressed by the pressing-target portion A2 while the drum unit 240 is being attached to the main casing 210. A rear end of the pressing surface F23 is connected to a rear end of the pressing-target surface F24. The pressing surface F23 extends diagonally forward and downward from the rear end of the pressing-target surface F24. The pressing-target surface F24 extends diagonally forward and upward from the rear end of the pressing surface F23.

The pressing surface F23 serves to transmit a pressing force FP2 of the second pressing member P2 to the corresponding pressing-target portion A2. The pressing surface F23 is formed to form such an angle that a component in the front-rear direction of the pressing force FP2 of the second pressing member P2 is greater than a component in the upper-lower direction thereof. That is, the pressing force FP2 of the second pressing member P2 has a component in the prescribed direction that is greater than a frictional force to be generated between the reference shaft A1 and the corresponding first main guide G31.

The pressing-target surface F24 is a cam surface configured to convert a downward force to be applied from the pressing-target portion A2 into a forward force. With this configuration, the moving member P21 moves forward against an urging force of the spring P22 while the pressing-target portion A2 presses the pressing-target surface F24 downward during the attachment of the drum unit 240 to the main casing 210.

Figure 17:
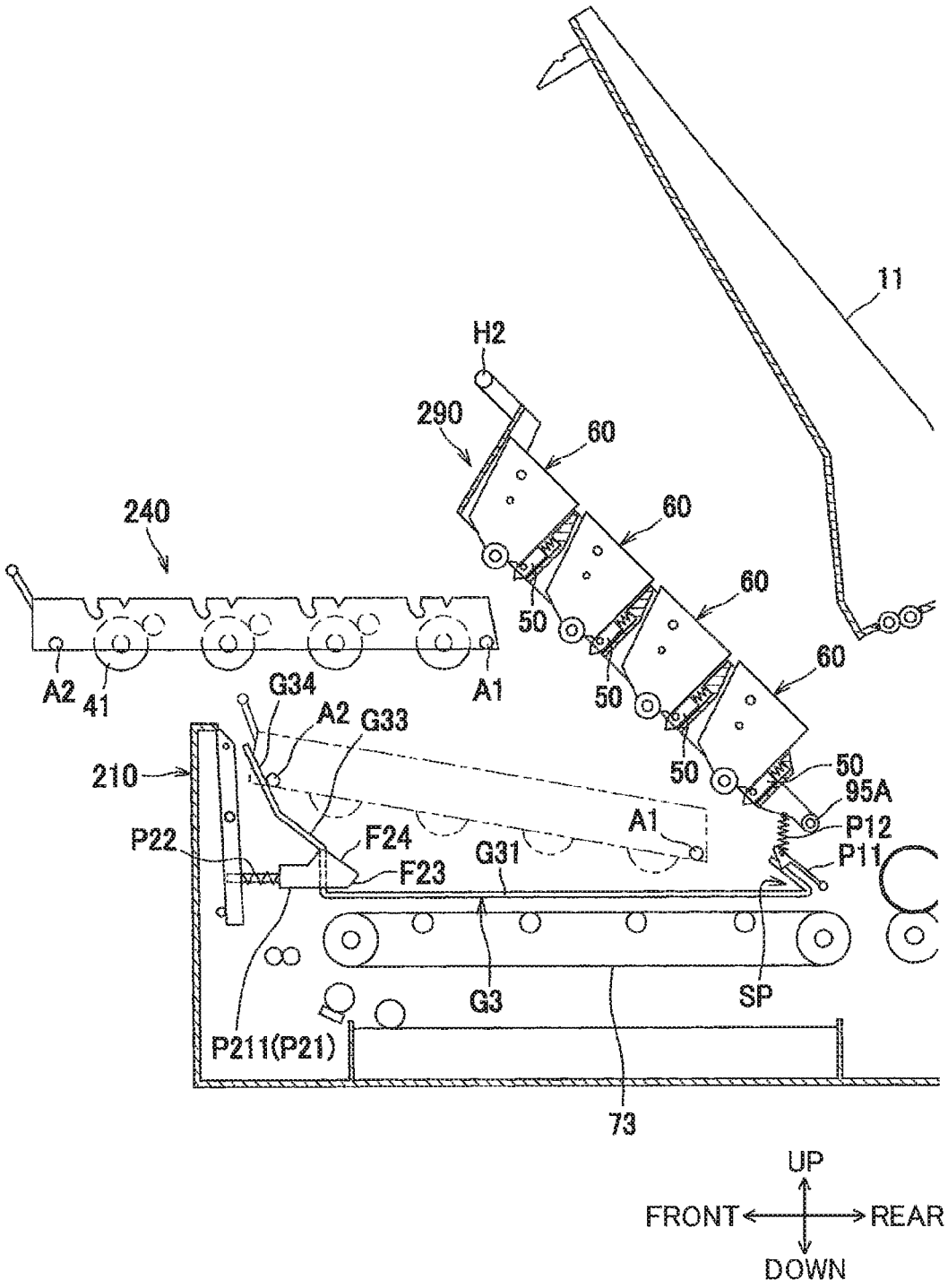
FIG. 17 is an explanatory view illustrating a state where the drum unit is about to be attached to the main casing according to the second embodiment.

As illustrated in FIG. 17, in a state where the drum unit 240 is detached from the main casing 210, the pressing-target surfaces F24 are positioned to extend along guide surfaces of the corresponding third main guides G33. Specifically, the pressing-target surfaces F24 are at such an angle that upper portions of the main portions P211 do not protrude upward relative to the guide surfaces of the corresponding third main guides G33.

Referring to FIG. 16, the support shaft P212 supports the spring P22. The support shaft P212 extends frontward from a front surface of the main portion P211. The support shaft P212 is disposed to penetrate through an internal space of the spring P22 (compression coil spring).

The spring P22 is disposed between the main portion P211 of the moving member P21 and the corresponding pivot member R. The spring P22 has one end in contact with the main portion P211, and another end in contact with the pivot member R.

The pivot member R is a plate-shaped member elongated in the upper-lower direction. The pivot member R is disposed adjacent to the support shaft P212 of the moving member P21 in the left-right direction. A longitudinal center portion of the pivot member R is supported by the main casing 210 so that the pivot member R is pivotable relative to the main casing 210. A lower end portion of the pivot member R is in contact with the spring P22. An upper end portion of the pivot member R is configured to contact a corresponding cam CM provided at the top cover 11.

Specifically, in a state where the top cover 11 is opened, the pivot member R is in an upright posture extending generally in the upper-lower direction as illustrated by a two-dot chain line in FIG. 16. More specifically, in the state where the top cover 11 is opened, the lower end portion of the pivot member R urged forward by the spring P22 is restricted from moving further forward by a stopper ST provided at the main casing 210. The pivot member R is thus kept in its upright posture elongated in the upper-lower direction.

The upper end portion of each pivot member R is formed with a protrusion R1 configured to contact the corresponding cam CM. Each cam CM includes a cam surface CM1 and an engagement groove CM2. The cam surface CM1 is adapted to press the corresponding protrusion R1 forward. The engagement groove CM2 is engageable with the protrusion R1.

With the pivot member R and the cam CM configured as described above, the cams CM of the top cover 11 come into contact with the respective pivot members R to cause the pivot members R to pivot counter-clockwise in FIG. 16 while the top cover 11 is being closed. As a result, the pivot members R press the corresponding second pressing members P2 toward the drum unit 240 in the front-rear direction. In the meantime, the protrusions R1 come into engagement with the respective engagement grooves CM2, thereby maintaining the top cover 11 in a closed state.

Next, operational advantages of the above-described structure for achieving positioning of the drum unit 240 relative to the main casing 210 will be described.

As illustrated in FIG. 17, in order to attach the drum unit 240, a user first opens the top cover 11 and bring the support member 290 into the separation position. In a state where the support member 290 is at the separation position, the lock members P11 coupled to the support member 290 via the springs P12 are each at the second position to allow the openings of the positioning portions SP to be exposed. The user can thus visually recognize the positioning portions SP easily.

Next, the user moves the drum unit 240 while keeping a rear end portion of the drum unit 240 lower than a front end portion thereof, so that the reference shafts A1 approach the respective positioning portions SP. In the meantime, the pressing-target portions A2 of the drum unit 240 are placed on the corresponding fourth main guides G34 or the third main guides G33. This structure can facilitate attachment of the drum unit 240, since the user need not to bear an entire weight of the drum unit 240.

Figure 18:
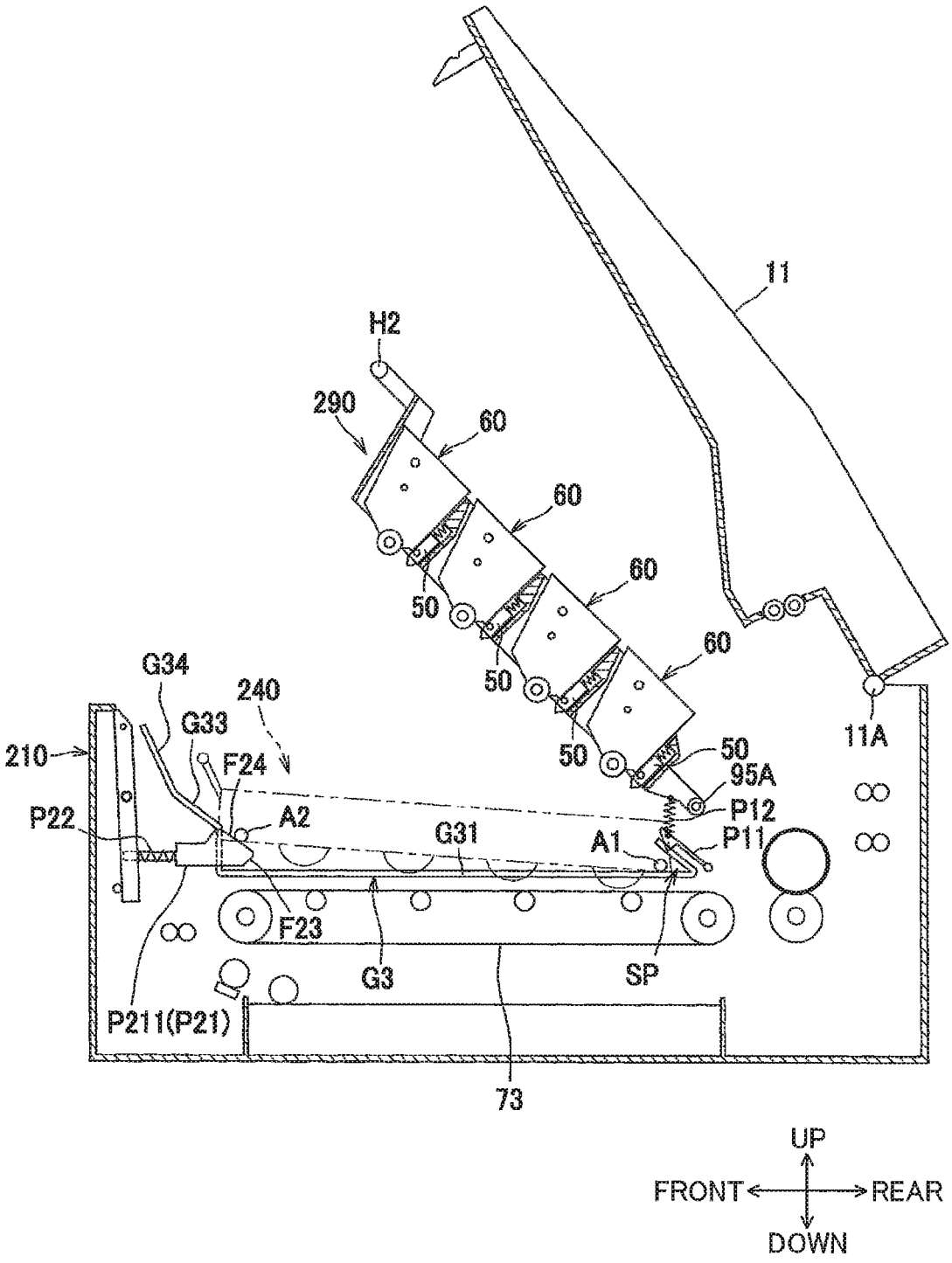
FIG. 18 is an explanatory view illustrating a state where a pressing-target portion of the drum unit is in contact with a second pressing member of the main casing according to the second embodiment.

As the user then causes the pressing-target portions A2 to slide diagonally downward and rearward along the third main guides G33, the pressing-target portions A2 are moved from the third main guides G33 onto the pressing-target surfaces F24 of the moving members P21, as illustrated in FIG. 18. With this configuration, a load of the drum unit 240 is transmitted to the pressing-target surfaces F24, thereby causing the pressing-target surfaces F24 to be pressed downward.

As the pressing-target surfaces F24 are pressed downward, the moving members P21 gradually move forward and the pressing-target portions A2 gradually move downward. As the moving members P21 move forward, the springs P22 are compressed to accumulate urging forces therein.

When the pressing-target portions A2 make contact with the first main guides G31, the pressing-target portions A2 are in contact with the pressing surfaces F23 of the corresponding moving members P21 so as to be pressed diagonally forward and downward by the pressing surfaces F23. At this time, since the pressing forces FP2 of the pressing surfaces F23 has a greater component in the front-rear direction than a component thereof in the upper-lower direction, the drum unit 240 can be moved against a frictional force between the photosensitive drums 41 and the conveyor belt 73. The reference shafts A1 can therefore be reliably pressed against the respective positioning portions SP.

Figure 19:
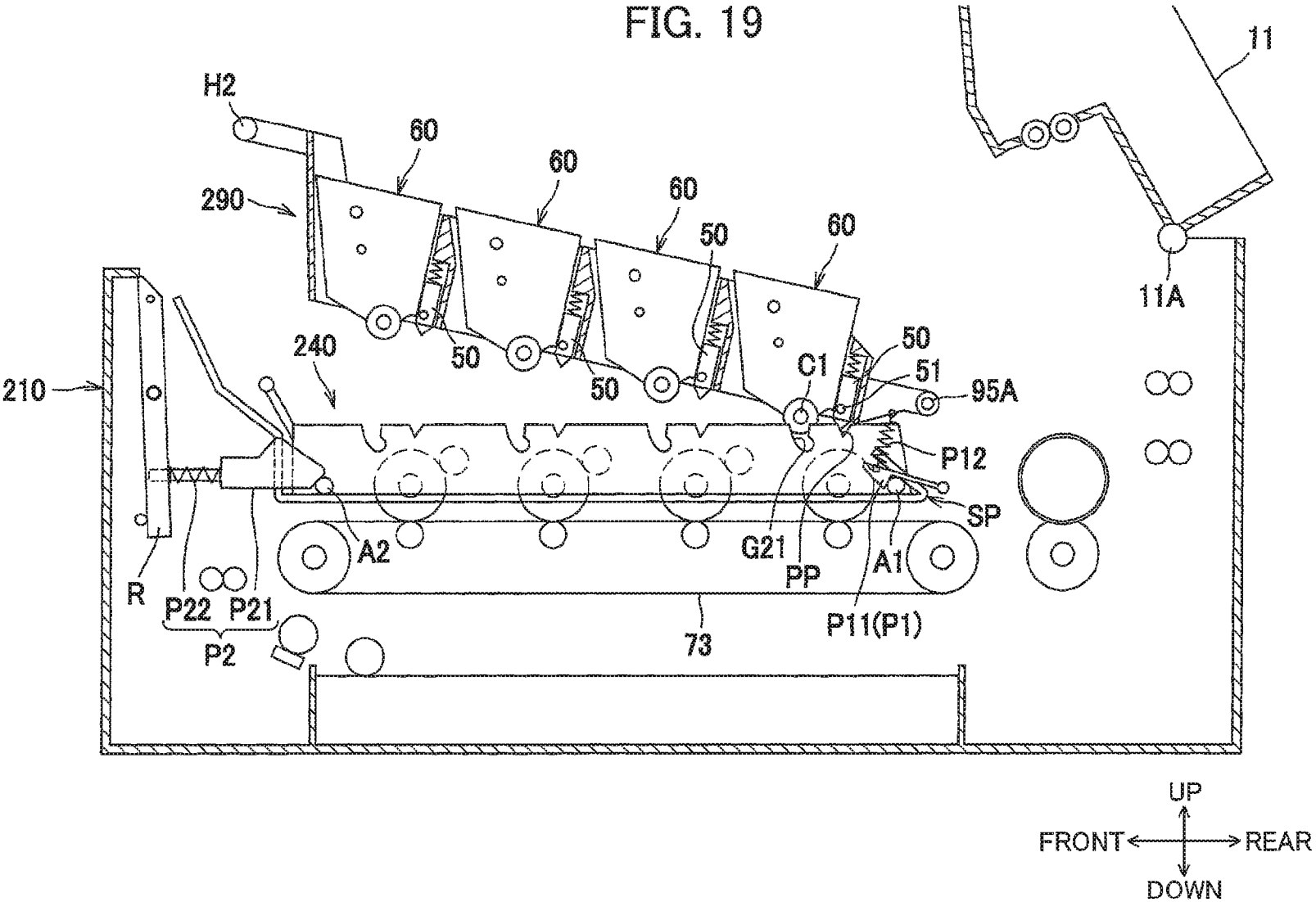
FIG. 19 is a schematic cross-sectional view illustrating a state of the support member according to the second embodiment is being pivoted from its separation position toward its exposure position.

Thereafter that, as the support member 290 is being pivoted from the separation position toward the exposure position as illustrated in FIG. 19, the lock members P11 coupled to the support member 290 via the springs P12 are caused to pivot from the second position toward the first position. Incidentally, in accordance with the pivoting of the support member 290 from the separation position to the exposure position, the lock members P11 are brought into contact with the reference shafts A1 of the drum unit 240 before the exposure heads 50 and the developing cartridges 60 are respectively brought into contact with the drum unit 240.

With this configuration, the lock members P11 are made in contact with the reference shafts A1 of the drum unit 240 to press the reference shafts A1 before the exposure heads 50 and the developing cartridges 60 respectively contact the drum unit 240 to generate a frictional force therewith. The position of the drum unit 240 can thus be precisely fixed.

Further, while the support member 290 is pivoted to the exposure position, the springs P12 are compressed between the support member 290 and the respective lock members P11 so that the urging forces are accumulated in the respective springs P12. Hence, the urging forces of the springs P12 and a force applied by the user to the support member 290 are transmitted to the reference shafts A1 via the contact surfaces F22 of the respective lock members P11 (refer to FIG. 16). At this time, since the pressing forces FP1 applied from the contact surfaces F22 to the reference shafts A1 have a component in the front-rear direction greater than a component in the upper-lower direction, the drum unit 240 can be moved against the frictional force between the photosensitive drums 41 and the conveyor belt 73. The reference shafts A1 can be pressed against the positioning portions SP further reliably.

That is, the drum unit 240 can be pressed against the positioning portions SP against the frictional force between the photosensitive drums 41 and the conveyor belt 73 by the pressing forces FP1 of the first pressing members P1 and the force applied by the user to the support member 290 when the support member 290 is moved from the separation position to the exposure position. The drum unit 240 can thus be precisely positioned relative to the main casing 210. Note that, in the exposure position, the support member 290 is locked in position relative to the main casing 210 by a lock mechanism (not illustrated).

As illustrated in FIG. 16, when the top cover 11 is closed after the support member 290 is pivoted to be at the exposure position, the cams CM press the protrusions R1 of the respective pivot members R to cause the pivot members R to pivot counter-clockwise. As a result, the springs P22 are further compressed between the lower end portions of the pivot members R and the corresponding moving members P21, thereby further increasing the pressing forces FP2. The reference shafts A1 can be further strongly pressed against the positioning portions SP.

According to the configuration of the second embodiment, the following technical advantages can be achieved in addition to those described above.

With the first pressing members P1 and the second pressing members P2, the drum unit 240 can be pressed to the positioning portions SP against the frictional force of the conveyor belt 73. The drum unit 240 can thus be precisely positioned relative to the main casing 210. Further, compared with a structure where the drum unit 240 is configured to be pressed only by the first pressing members P1, for example, the pressing force of the first pressing members P1 can be made smaller. Hence, this structure of the second embodiment can reduce a counter force that is to be applied from the first pressing members P1 to the user operating the support member 290 for placing the support member 290 at the exposure position.

The top cover 11 (cams CM) is configured to come into contact with the pivot members R in accordance with the user's closing of the top cover 11. The pivot members R are accordingly caused to pivot to press the respective second pressing members P2 toward the drum unit 240. In this way, the force for closing the top cover 11 can be utilized as a force for providing positioning of the drum unit 240.

Further, the opening of the top cover 11 can cause the cams CM to disengage from the corresponding pivot members R. The pivot members R are thus caused to return to respective original positions due to the urging forces of the springs P22, which in turn weakens the urging forces of the springs P22. In a state where the top cover 11 is open, the pressing forces applied from the second pressing members P2 to the drum unit 240 also become smaller. Accordingly, the structure of the second embodiment can facilitate attachment and removal of the drum unit 240, since the user is required of a smaller force for performing the attachment and removal of the drum unit 240 than otherwise.

According to the configuration of the second embodiment, the lock members P11 are respectively coupled to the springs P12 provided at the support member 290. Hence, by the movement of the support member 290 from the exposure position to the separation position, the lock members P11 coupled to the springs P12 are caused to pivot, and are allowed to disengage from the respective reference shafts A1. The user is not required to perform an operation for disengaging the lock members P11, and, hence, enhanced operability can be obtained.

When the support member 90 is at the separation position, the lock members P11 are at the second position at which the openings of the positioning portions SP are open. With this structure, the user can easily recognize the positioning portions SP at the time of the user's attachment of the drum unit 240 to the main casing 210, improving the user's operability.

The first pressing members P1 and the second pressing members P2 are provided one each at each side in the left-right direction with respect to the drum unit 240. The drum unit 240 can be pressed in a well-balanced manner by the respective first pressing members P1 and the second pressing member P2 disposed on both sides of the drum unit 240 in the left-right direction.

Various modifications and variations are available to the second embodiment, as described below. Like parts and components are designated with the same reference numerals as those of the second embodiment to avoid duplicating description.

In the second embodiment, pivotable or movable members (the lock members P11 or the moving members P21) and the springs P12 and P22 are employed as an example of a pressing member of the disclosure. Alternatively, the pressing member may be configured of a spring only, for example. The spring may be a leaf spring or a torsion spring, for example.

The lock members P11 and the springs P12 are coupled to each other in the second embodiment. However, the lock members and the springs may not be coupled to each other.

The conveyor belt 73 is employed as a belt of the disclosure for conveying the sheets P with the photosensitive drums 41 in the second embodiment. However, the belt of the disclosure may be an intermediate transfer belt to which developer images are transferred from the photosensitive bodies.

The top cover 11 is employed as a cover of the disclosure in the second embodiment. Alternatively, the cover may be a front cover configured to open and close an opening formed in a front end portion of a main casing.

Third Embodiment

Next, a color printer 301 according to a third embodiment will be described based on FIGS. 20 to 25. Hereinafter, like parts and components are designated with the same reference numerals as the first embodiment in order to avoid duplicating description.

The color printer 301 according to the third embodiment includes a drum unit 340 and a support member 390, instead of the drum unit 40 and support member 90 of the first embodiment.

Figures 22A, 22B:
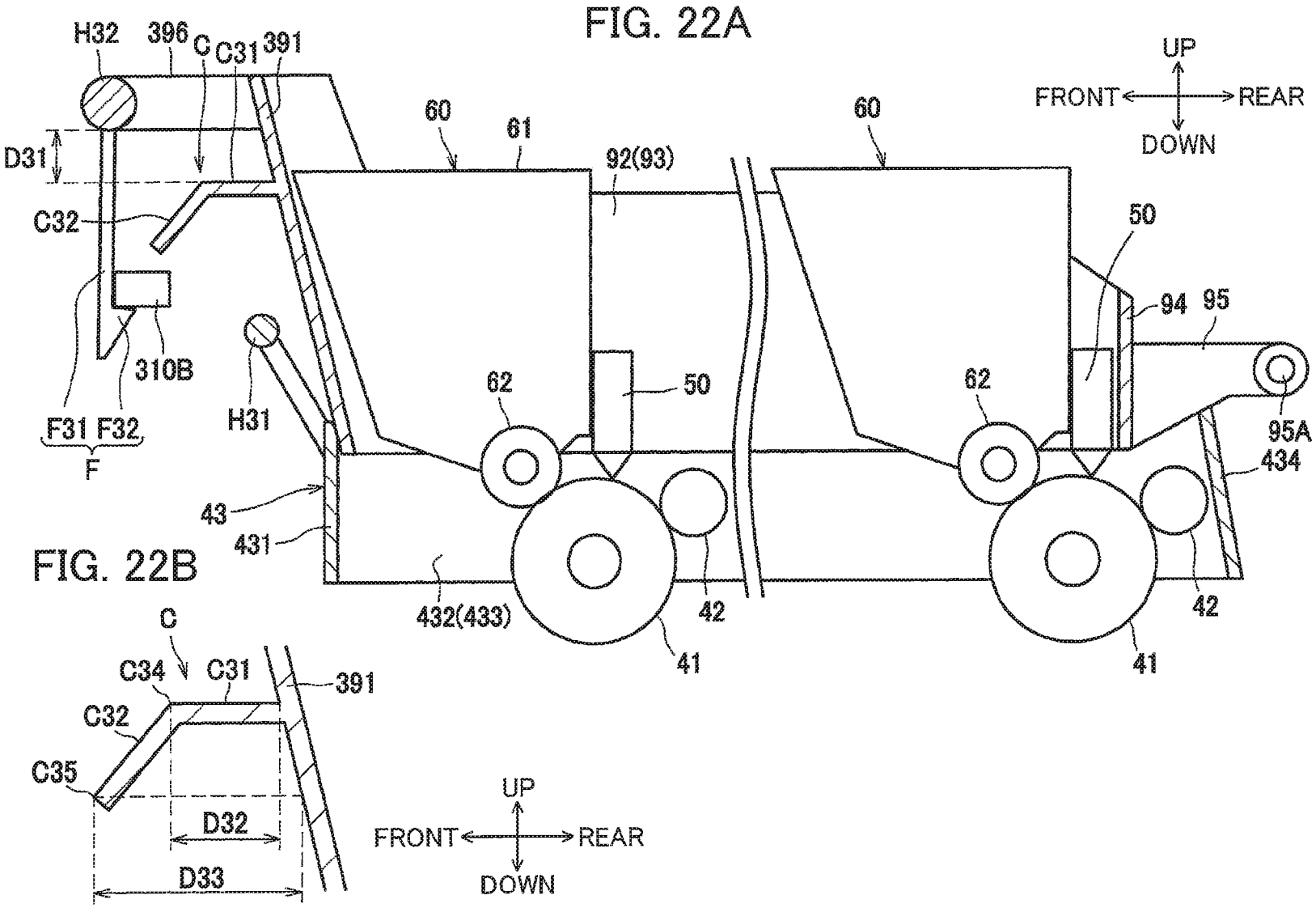
FIG. 22A is a partially-enlarged view schematically illustrating front and rear end portions of a drum unit and front and rear end portions of a support member according to the third embodiment.
FIG. 22B is a view schematically illustrating a structure of a cover provided at the support member according to the third embodiment.
Figure 23:
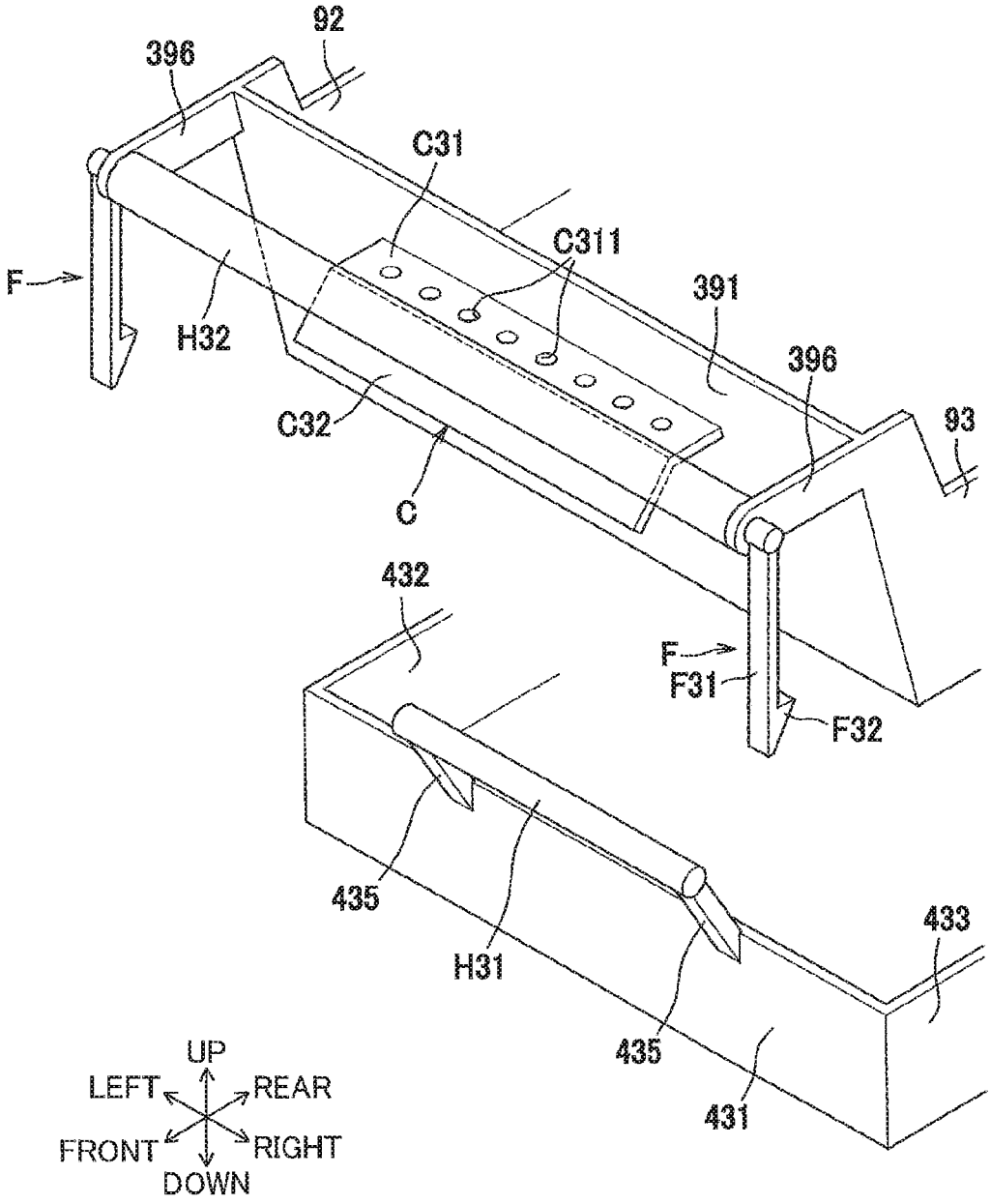
FIG. 23 is a partially-enlarged perspective view illustrating structures in the vicinity of a handle of the drum unit and a handle of the support member according to the third embodiment.

Specifically, as illustrated in FIGS. 22A, 22B, and 23, the drum frame 43 includes the front wall 431, the side walls 432 and 433, the rear wall 434 of the first embodiment, and a handle H31.

The handle H31 is a columnar-shaped handle extending in the left-right direction. Both end portions in the left-right direction of the handle H31 are connected to the upper end portion of the front wall 431 via two arm members 435. The handle H31 has a length in the left-right direction that is smaller than a length of the front wall 431 in the left-right direction. The handle H31 is disposed on a center portion in the left-right direction of the front wall 431. Each arm member 435 extends diagonally forward and upward from the upper end portion of the front wall 431. The handle H31 is fixed to respective tip ends of the arm members 435.

That is, the handle H31 is disposed away from the front wall 431 in the horizontal direction and the upper-lower direction, and, specifically, forward and upward.

The support member 390 includes a front wall 391, the side walls 92 and 93, the rear wall 94, a handle H32, and a cover C. The front wall 391 is disposed frontward of the plurality of developing cartridges 60, just as the front wall 91 of the first embodiment.

The handle H32 is a columnar-shaped handle extending in the left-right direction. Both end portions in the left-right direction of the handle H32 are connected to the upper end portion of the front wall 391 via two handle supports 396. Each handle support 396 extends forward from each end portion in the left-right direction on the upper end portion of the front wall 391. The handle H32 is disposed away from the front wall 391 in the horizontal direction (i.e., forward). The handle H32 is rotatably supported by respective tip ends of the handle supports 396.

The handle H32 disposed frontward of the handle H31. The handle H32 is positioned at another end portion of the support member 390 in the front-rear direction. The handle H32 has a length in the left-right direction greater than the length of the handle H31 in the left-right direction. The handle H32 includes a pair of hooks F one each at each end portion of the handle H32 in the left-right direction, i.e., the axial direction of each photosensitive drum 41. The hooks F are pivotable relative to the handle supports 396 in accordance with rotation of the handle H32.

The hooks F are disposed at the other end portion of the support member 390 in the front-rear direction. Each hook F includes a base portion F31 and a claw portion F32. The base portion F31 extends downward from each end portion of the second handle H32 in the left-right direction. The claw portion F32 protrudes rearward from a lower end portion of the base portion F31. When the support member 390 is at the exposure position, the claw portions F32 are respectively configured to engage locking portions 310B provided at a main casing 310 of the color printer 301. The locking portion 310B may be a part or a portion constituting the main casing 310 or a part fixed to the main casing 310.

The cover C is positioned between the handle H32 and handle H31 to cover the handle H31 from above in a state where the drum unit 340 is attached to the main casing 310 and the support member 390 is at the exposure position. The cover C is positioned between the handle H32 and the claw portions F32 in the upper-lower direction. The cover C is positioned between the hooks F and the front wall 391 in the front-rear direction.

The cover C is disposed between the hooks F in the left-right direction. The cover C has a length in the left-right direction that is greater than the length of the handle H31 in the left-right direction. That is, each end in the left-right direction of the cover C is positioned outward relative to each end of the handle H31 in the left-right direction. The cover C has a dimension in the front-rear direction greater than a dimension of the handle H31 in the front-rear direction. That is, each end in the front-rear direction of the cover C is positioned outward relative to each end of the handle H31 in the front-rear direction.

Figure 24:
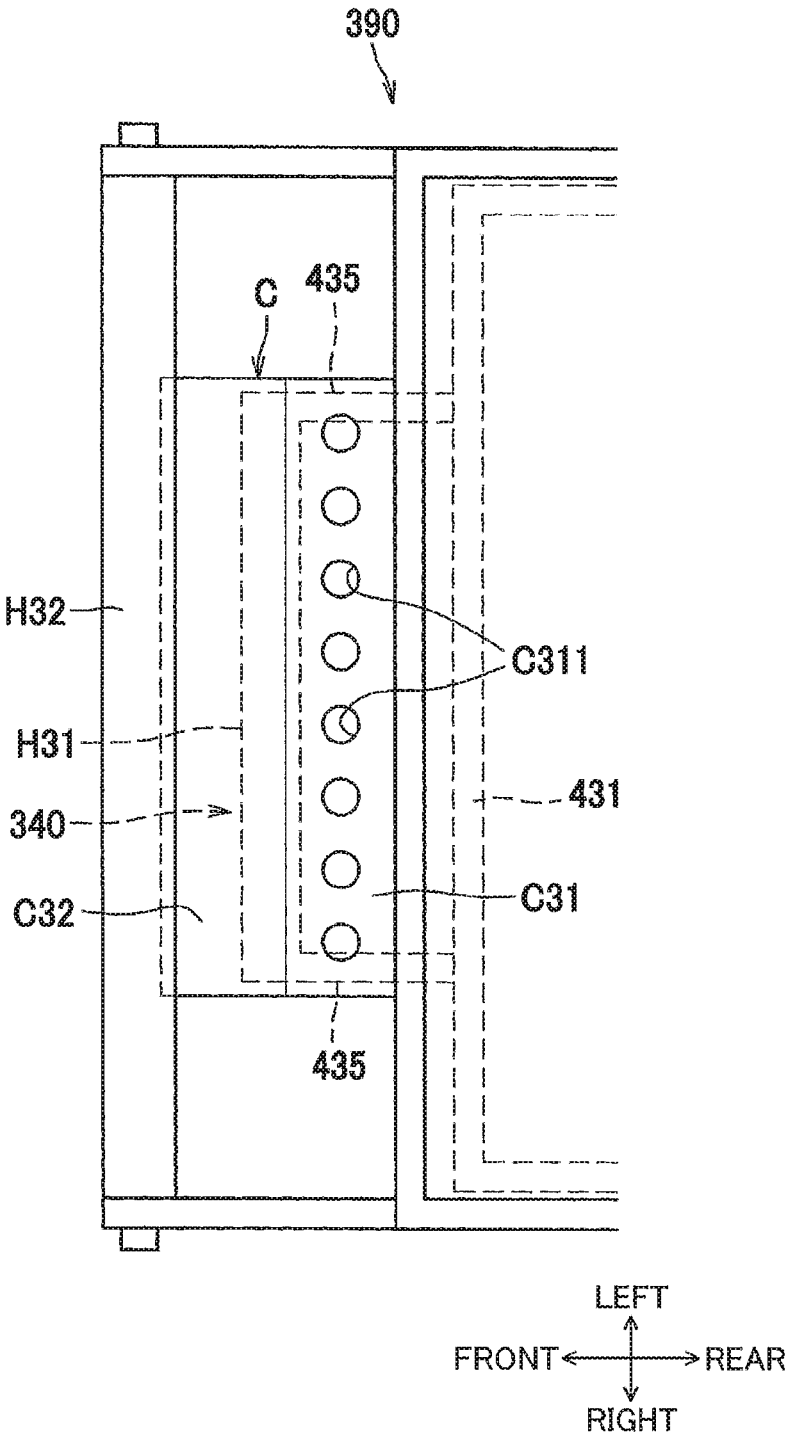
FIG. 24 is a partial plan view illustrating the handle and the cover of the drum unit and the handle of the support member according to the third embodiment as viewed from above thereof.

The cover C includes a horizontal portion C31 and an inclined portion C32. The horizontal portion C31 extends forward from the front wall 391. The inclined portion C32 extends diagonally forward and downward from a front end of the horizontal portion C31. The horizontal portion C31 is formed with a plurality of holes C311 each penetrating through a thickness of the horizontal portion C31 in the upper-lower direction. As illustrated in FIG. 24, the holes C311 are open toward a space between the handle H31 and the front wall 431, more specifically, a space surrounded by the handle H31, the front wall 431, and the arm members 435

As illustrated in FIGS. 22A and 22B, the inclined portion C32 is inclined relative to the horizontal direction such that the inclined portion C32 extends away from the handle H32 in the upper-lower direction as extending forward. The horizontal portion C31 has a front end portion C34. The inclined portion C32 has a front end portion C35. In the front-rear direction, a distance D32 from the front end portion C34 of the horizontal portion C31 to the front wall 391 is smaller than a distance D33 from the front end portion C35 of the inclined portion C32 to the front wall 391.

The left-right length of the cover C may range from 130 mm to 150 mm inclusive, for example. A thickness of the cover C may range from 1.6 mm to 2 mm inclusive. Furthermore, a gap D31 in the upper-lower direction between the handle H32 and the cover C may range from 30 mm to 50 mm inclusive.

Next, operations and technical advantages of the configuration including the cover C described above will be described.

Figure 20:
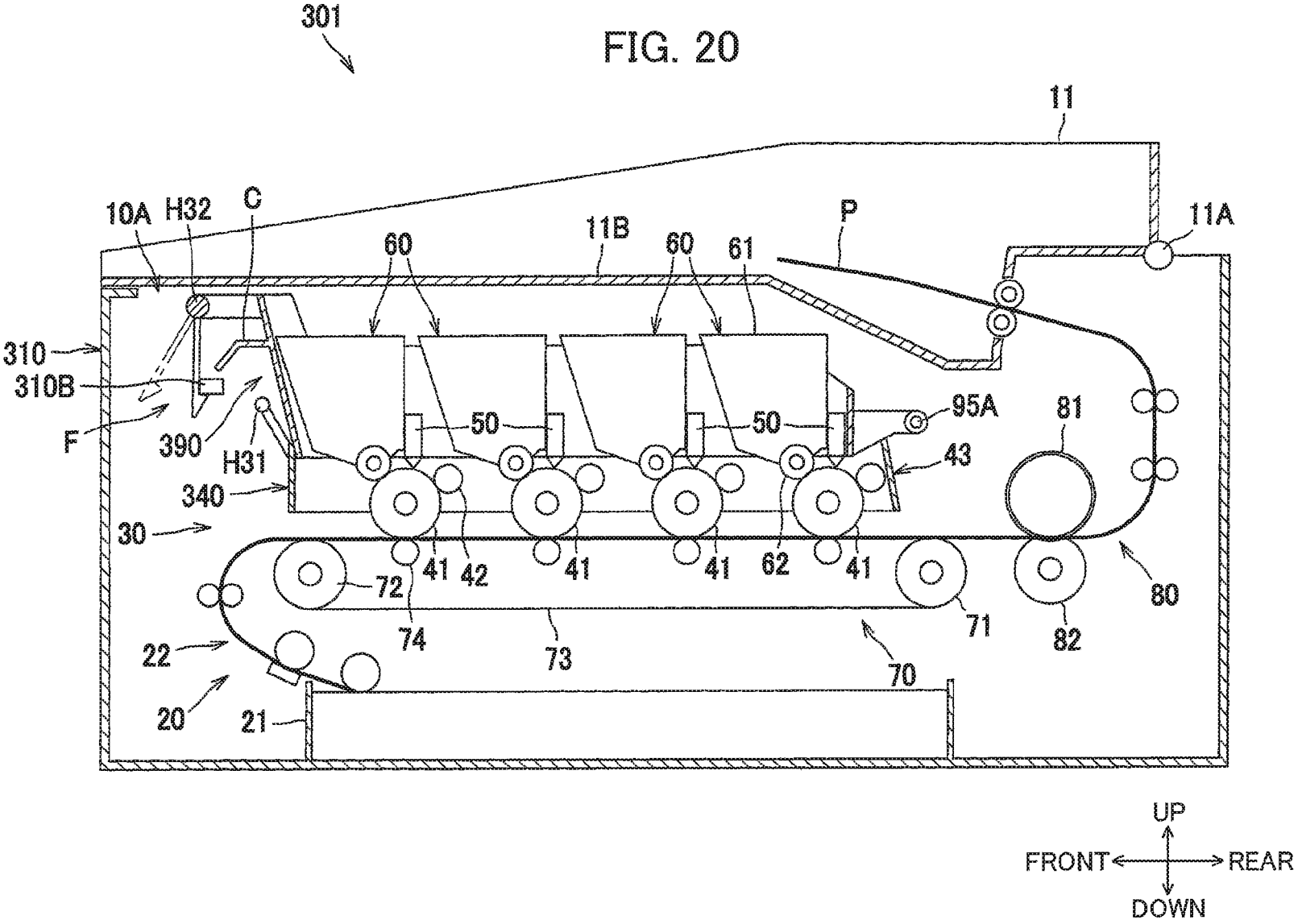
FIG. 20 is a schematic cross-sectional view illustrating an internal structure of a color printer according to a third embodiment of the disclosure.
Figure 21:
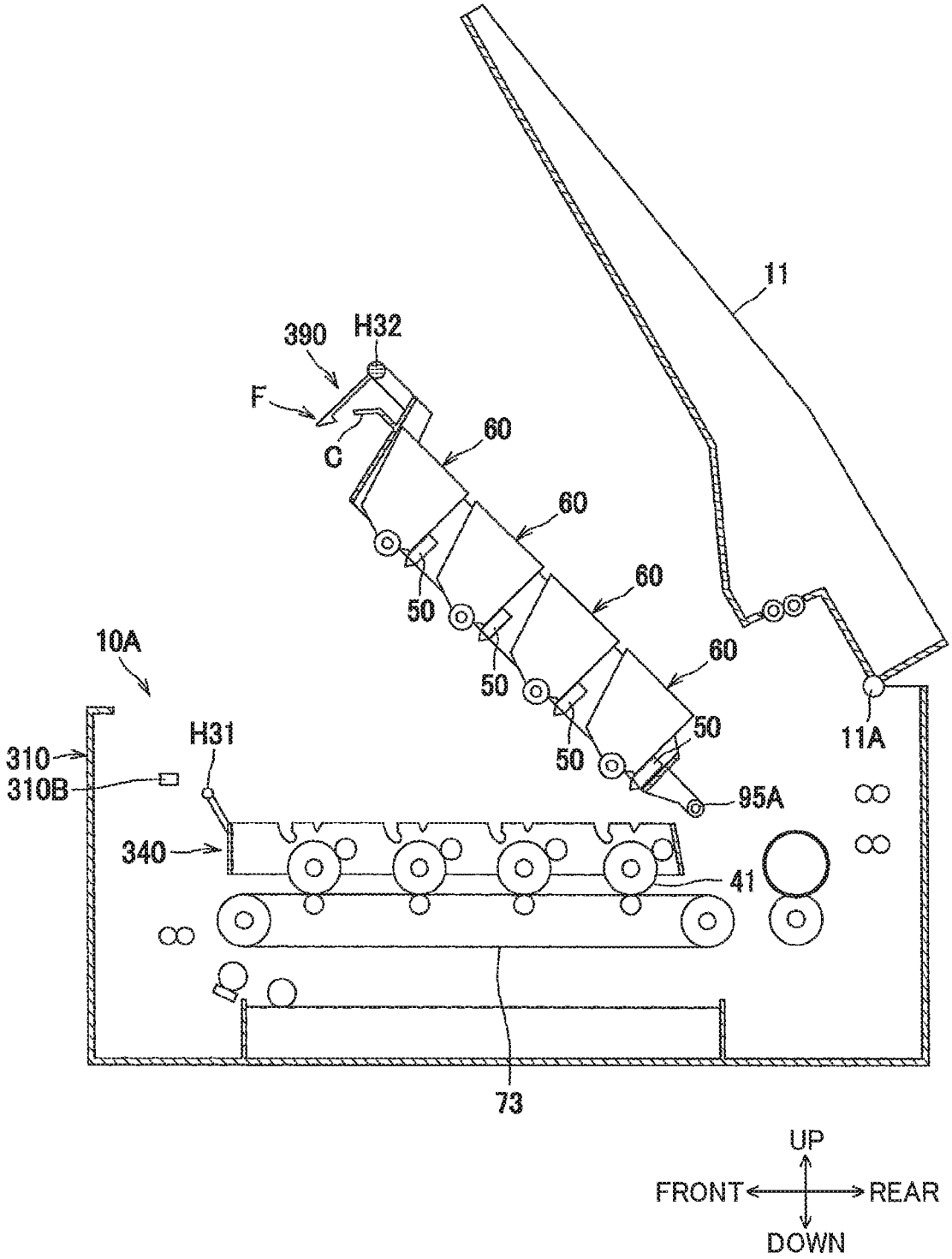
FIG. 21 is a schematic cross-sectional view of the color printer according to the third embodiment in a state where a top cover thereof is opened.

When a user opens the top cover 11 from the state illustrated in FIG. 20, the user can see the handle H32 of the support member 390. However, the user cannot see the handle H31 of the drum unit 340 because the handle H31 is covered by the cover C. With this configuration, the user who intends to grab the handle H32 of the support member 390 can reliably grab the handle H32 alone, and is prevented from mistakenly grabbing the handle H31 together with the handle H32.

As the user grabs the handle H32 and rotates the handle H32 in order to pivot the support member 390, the hooks F are disengaged from the locking portion 310B. With this configuration, compared with a structure provided with a member for operating hooks separately from a handle of the support member, for example, the hooks F can be easily disengaged from the main casing 310.

According to the third embodiment as described above, the following technical advantages can also be achieved.

The cover C includes the inclined portion C32 that is inclined to extend away from the handle H32 in the upper-lower direction toward frontward. With this structure of the cover C, even if the handle H31 and the handle H32 are positioned closer to each other in the upper-lower direction, a space can still be provided between the handle H32 and the cover C for enabling the user to insert his fingers therebetween to grab the handle H32. Since the handle H31 and the handle H32 can be provided closer to each other in the upper-lower direction, the color printer 301 can be made compact in the upper-lower direction.

The cover C is formed with the holes C311 opening toward the space between the handle H31 and the front wall 431. With this structure, air is allowed to flow from the handle H32 toward the photosensitive drums 41 or from the photosensitive drums 41 toward the handle H32 without being blocked by the cover C.

Further, the hooks F are provided one each on each end of the handle H32 in the left-right direction. The support member 390 can therefore be stably secured relative to the main casing 310.

It would be apparent to those skilled in the art that various modifications and variations may be made in the depicted third embodiment. Hereinafter, like parts and components are designated with the same reference numerals as the third embodiment in order to avoid duplicating description.

Figure 25:
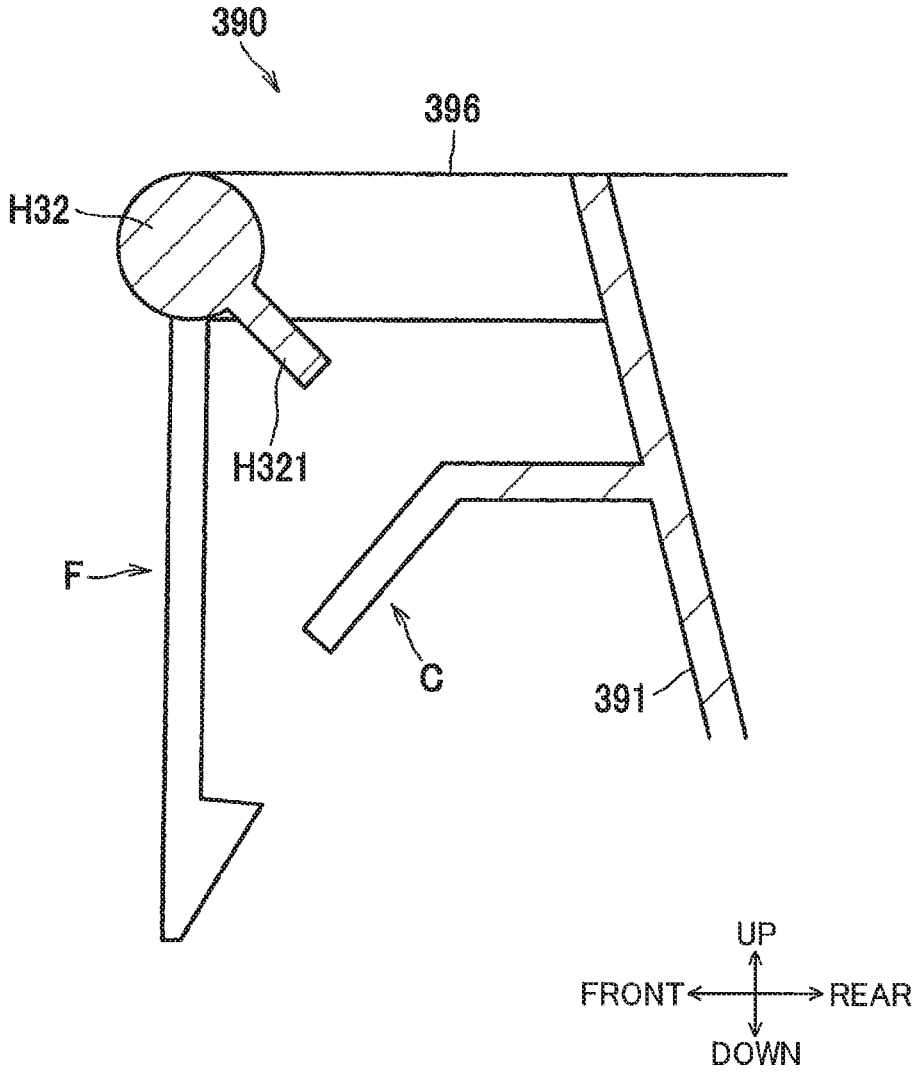
FIG. 25 is a partially-enlarged cross-sectional view illustrating a handle of a support member according to a variation of the third embodiment.

In the third embodiment, the handle H31 and the handle H32 each have a columnar shape. However, the handles H31 and H32 may be any polygonal-shaped column. In a case where the handle H32 has a circular columnar shape, preferably, the handle H32 be provided with a protruding segment H321 protruding from an outer peripheral surface of the handle H32, as illustrated in FIG. 25. Further preferably, in this case, a tip end of the protruding segment H321 be positioned between the handle H32 and the front wall 391 in the front-rear direction.

With this configuration of FIG. 25, the user's fingers come into contact with the protruding segment H321 when the user grabs the handle H32. The user can therefore rotate the handle H32 easily, thereby facilitating disengagement of the hooks F from the main casing 310. Further, the tip end of the protruding segment H321 is positioned between the handle H32 and the front wall 391. The user can easily grab the handle H32, since his fingers inserted between the handle H32 and the front wall 391 easily contact the protruding segment H321. Disengagement of the hooks F from the main casing 310 can be further facilitated.

In the third embodiment, the handle H31 is fully covered by the cover C so that the user cannot see the handle H31 in a state where the support member 390 is at the exposure position. However, the handle H31 may not be fully covered by the cover C. For example, a cover may be formed with a plurality of slits so that the user can see the handle through the slits. Even in this case, as long as the user cannot access the handle H31 over the cover, for example, by forming each of the slits to have a width narrower than a width of a finger, the user is less likely to grab the handle of the drum unit together with the handle of the support member.

In the third embodiment, the pivot shaft 95A is disposed at one end portion of the support member 390 in the front-rear direction, i.e., the arrangement direction of the plurality of photosensitive drums 41, whereas the handle H32 is disposed on the other end portion of the support member 390 in the front-rear direction. However, the pivot shaft of the support member may be disposed at one end of the support member in the axial direction of each photosensitive drum, whereas the handle of the support member may be disposed on another end portion of the support member in the axial direction.

In the above-described first to third embodiments, a color printer is employed as an example of an image-forming apparatus of the disclosure. However, the image-forming apparatus of the disclosure may be embodied as other types of image-forming apparatuses, such as monochrome printers, copying machines, and multifunction devices.

The above-described embodiments and modifications may be combined as appropriate.

It would be apparent to those skilled in the art that the embodiment described above is merely an example of the present disclosure and modifications and variations may be made therein without departing from the scope of the disclosure.

<Remarks>

The color printers 1, 201 and 301 are an example of an image-forming apparatus. The drum units 40, 240, 340 are an example of a drum unit. The exposure head 50 is an example of an exposure head. The developing cartridges 60, 60' are an example of a developing cartridge. The support members 90, 290 and 390 are an example of a support member. The first protrusion C1 is an example of a first protrusion. The second protrusion C2 is an example of a second protrusion. The third protrusion C3 is an example of a third protrusion. The first guide G21 is an example of a first guide. The second guide G22 is an example of a second guide. The cartridge guide G1 is an example of a cartridge guide. The main guide G11 is an example of a main guide. The sub-guide G12 is an example of a sub-guide. The cartridge pressing portion 100 is an example of urging member. The lever 110 is an example of a lever. The spring 120 is an example of a spring. The bottom surface F1 is an example of a nearest surface. The conveyor belt 73 is an example of a belt. The main casing 210 is an example of a housing. The positioning portion SP is an example of a positioning portion. The first pressing member P1 is an example of a first pressing member. The second pressing member P2 is an example of a second urging member. The main guide G3 is an example of a drum guide. The reference shaft A1 is an example of a reference shaft. The top cover 11 is an example of a cover. The pivot member R is an example of a pivot member. The spring P12 is an example of a spring. The lock member P11 is an example of a lock member. The groove 93A is an example of a groove. The head pressing member 98 is an example of a pressing member. The opposing surface 52 is an example of a head surface. The opposing surface 60F is an example of a cartridge surface. The first wall 97 is an example of a first wall of the support member. The rear wall 94 is an example of a second wall of the support member. The side walls 92, 93 are an example of side walls of the support member. The main casing 310 is another example of a housing. The handle H31 is an example of a first handle. The handle H32 is an example of a second handle. The cover C is an example of a handle cover. The inclined portion C32 is an example of a sloped portion. The front wall 431 is an example of a first wall of the drum unit. The front wall 391 is another example of a second wall of the support member. The hook F is an example of a hook. The handle support 396 is an example of a handle support. The protruding segment H321 is an example of a protruding segment.

What is claimed is:

1. An image-forming apparatus comprising:

a drum unit comprising a photosensitive drum;

an exposure head configured to expose the photosensitive drum to light;

a developing cartridge configured to store developer therein; and a support member configured to support the exposure head and the developing cartridge, the support member being pivotally movable between an exposure position where the exposure head is able to expose the photosensitive drum to light and a separation position where the exposure head is positioned away from the photosensitive drum, wherein the photosensitive drum defines a rotation axis extending in an axial direction;

wherein the developing cartridge comprises:

a casing configured to store the developer therein;

a first protrusion protruding from the casing in the axial direction;

a second protrusion protruding from the casing in the axial direction and positioned farther away from the photosensitive drum than the first protrusion is from the photosensitive drum; and a third protrusion protruding from the casing in the axial direction and positioned farther away from the photosensitive drum than the second protrusion is from the photosensitive drum;

wherein the drum unit includes a first guide and a second guide configured to guide the first protrusion during movement of the support member supporting the developing cartridge from the separation position to the exposure position, the first guide extending in a first direction, and the second guide extending in a second direction different from the first direction to guide the first protrusion having been guided by the first guide toward the photosensitive drum;

wherein the support member includes a cartridge guide configured to guide the second protrusion and the third protrusion during attachment of the developing cartridge to the support member, the cartridge guide including a main guide and a sub-guide, the main guide extending in a third direction different from the second direction to guide the second protrusion and the third protrusion, the sub-guide being positioned at an end of the main guide, a clearance between the sub-guide and the second protrusion in a direction perpendicular to the third direction being greater than a clearance between the main guide and the third protrusion in the direction perpendicular to the third direction; and wherein the second protrusion is at the sub-guide and the third protrusion is at the main guide when the first protrusion is at the second guide.

2. The image-forming apparatus according to claim 1, further comprising an urging member provided at the support member, the urging member being configured to urge the developing cartridge toward the photosensitive drum when the support member supports the developing cartridge.

3. The image-forming apparatus according to claim 2, wherein the urging member comprises:

a lever pivotally movably supported by the support member and configured to urge the second protrusion of the developing cartridge; and a spring urging the lever.

4. The image-forming apparatus according to claim 3, wherein the second protrusion is nipped between the lever and the sub-guide when the support member is at the separation position.

5. The image-forming apparatus according to claim 4, wherein the sub-guide has a nearest surface closest to the photosensitive drum among surfaces constituting the sub-guide; and wherein the second protrusion is in contact with the lever and in separation from the nearest surface of the sub-guide when the support member is at the exposure position.

6. The image-forming apparatus according to claim 1, wherein the support member and the first guide overlap with each other as viewed in the axial direction when the support member is at the exposure position.

7. The image-forming apparatus according to claim 1, wherein the second guide extends along a normal line which is normal to an outer peripheral surface of the photosensitive drum.

8. The image-forming apparatus according to claim 1, wherein the drum unit comprises a plurality of the photosensitive drums juxtaposed in a prescribed direction;

wherein the support member supports a plurality of the exposure heads juxtaposed in the prescribed direction;

wherein the support member is configured to support a plurality of the developing cartridges juxtaposed in the prescribed direction;

wherein the support member includes a plurality of the cartridge guides each configured to guide the second protrusion and the third protrusion of the corresponding developing cartridge, each sub-guide having a nearest surface closest to the corresponding photosensitive drum among surfaces constituting the sub-guide;

wherein the support member supporting the plurality of the exposure heads and the plurality of the developing cartridges is pivotally movable about a pivot axis; and wherein the second protrusions of the respective developing cartridges are separated from the nearest surfaces of the corresponding sub-guides sequentially in an order from the second protrusion closest to the pivot axis toward the second protrusion farthest from the pivot axis in the prescribed direction in accordance with pivotal movement of the support member from the separation position toward the exposure position.

* * * * *